US009909228B2

(12) United States Patent
He

(10) Patent No.: US 9,909,228 B2
(45) Date of Patent: Mar. 6, 2018

(54) METHOD AND APPARATUS FOR DYNAMIC CURRENT DISTRIBUTION CONTROL DURING ELECTROPLATING

(71) Applicant: Lam Research Corporation, Fremont, CA (US)

(72) Inventor: Zhian He, Lake Oswego, OR (US)

(73) Assignee: Lam Research Corporation, Fremont, CA (US)

( * ) Notice: Subject to any disclaimer, the term of this patent is extended or adjusted under 35 U.S.C. 154(b) by 1092 days.

(21) Appl. No.: 14/067,616

(22) Filed: Oct. 30, 2013

(65) Prior Publication Data

US 2014/0144781 A1 May 29, 2014

Related U.S. Application Data

(60) Provisional application No. 61/730,285, filed on Nov. 27, 2012.

(51) Int. Cl.
*C25D 17/00* (2006.01)
*C25D 7/12* (2006.01)
(Continued)

(52) U.S. Cl.
CPC ..... *C25D 17/001* (2013.01); *C25D 7/123* (2013.01); *C25D 17/007* (2013.01);
(Continued)

(58) Field of Classification Search
CPC ..... C25D 7/123; C25D 17/001
See application file for complete search history.

(56) References Cited

U.S. PATENT DOCUMENTS 3,880,725 A 4/1975 Van Raalte et al.
4,304,641 A 12/1981 Grandia et al.
(Continued)

FOREIGN PATENT DOCUMENTS

CA 1 236 627 7/1986
CN 1531028 A 9/2004
(Continued)

OTHER PUBLICATIONS

U.S. Appl. No. 13/907,265, filed May 31, 2013, entitled "Method and Apparatus for Electroplating."
(Continued)

*Primary Examiner* — Bryan D. Ripa
(74) *Attorney, Agent, or Firm* — Weaver Austin Villeneuve & Sampson LLP

(57) ABSTRACT

An apparatus for electroplating a layer of metal onto the surface of a wafer includes an auxiliary electrode that is configured to function both as an auxiliary cathode and an auxiliary anode during the course of electroplating. The apparatus further includes an ionic current collimator (e.g., a focus ring) configured to direct ionic current from the main anode to central portions of the wafer. The provided configuration effectively redistributes ionic current in the plating system allowing plating of uniform metal layers and mitigating the terminal effect. In one example, the auxiliary electrode functions as an auxiliary cathode in the beginning of electroplating when the terminal effect is pronounced, and subsequently is anodically biased.

16 Claims, 13 Drawing Sheets

(51) Int. Cl.
*C25D 5/02* (2006.01)
*C25D 17/10* (2006.01)
*C25D 21/12* (2006.01)

(52) U.S. Cl.
CPC ..... *C25D 17/008* (2013.01); *C25D 5/022* (2013.01); *C25D 17/10* (2013.01); *C25D 21/12* (2013.01)

(56) References Cited

U.S. PATENT DOCUMENTS 4,696,729 A 9/1987 Santini
5,078,852 A 1/1992 Yee et al.
5,169,684 A 12/1992 Takagi
5,312,352 A 5/1994 Leschinsky et al.
5,312,532 A 5/1994 Andricacos et al.
5,620,581 A 4/1997 Ang
5,723,028 A 3/1998 Poris
5,774,019 A 6/1998 Koyama et al.
6,004,440 A 12/1999 Hanson et al.
6,027,631 A 2/2000 Broadbent
6,071,388 A 6/2000 Uzoh
6,074,544 A 6/2000 Reid et al.
6,099,702 A 8/2000 Reid et al.
6,106,687 A 8/2000 Edelstein
6,110,346 A 8/2000 Reid et al.
6,126,798 A 10/2000 Reid et al.
6,132,587 A 10/2000 Jorne et al.
6,132,805 A 10/2000 Moslehi
6,156,167 A 12/2000 Patton et al.
6,162,344 A 12/2000 Reid et al.
6,168,693 B1 1/2001 Uzoh et al.
6,174,425 B1 1/2001 Simpson et al.
6,179,983 B1 1/2001 Reid et al.
6,193,860 B1 2/2001 Weling
6,228,231 B1 6/2001 Uzoh
6,261,433 B1 * 7/2001 Landau ..... C25D 3/38 204/230.2
6,322,674 B1 11/2001 Berner et al.
6,391,166 B1 5/2002 Wang
6,391,168 B1 * 5/2002 Ueno ..... C25D 7/123 204/224 R
6,402,923 B1 6/2002 Mayer et al.
6,425,991 B1 7/2002 Tran et al.
6,497,801 B1 12/2002 Woodruff et al.
6,514,393 B1 2/2003 Contolini et al.
6,527,920 B1 3/2003 Mayer et al.
6,551,483 B1 4/2003 Mayer et al.
6,569,299 B1 5/2003 Reid et al.
6,599,412 B1 7/2003 Graham et al.
6,627,051 B2 9/2003 Berner et al.
6,627,052 B2 9/2003 Fluegel et al.
6,632,335 B2 10/2003 Kunisawa et al.
6,716,334 B1 4/2004 Reid et al.
6,755,954 B2 6/2004 Mayer et al.
6,773,571 B1 8/2004 Mayer et al.
6,800,187 B1 10/2004 Reid et al.
6,843,894 B2 1/2005 Berner et al.
6,919,010 B1 7/2005 Mayer et al.
6,988,932 B2 1/2006 Ashjaee et al.
7,288,177 B2 10/2007 Barrese et al.
7,323,094 B2 1/2008 Simpson et al.
7,383,521 B2 6/2008 Smith et al.
7,622,024 B1 * 11/2009 Mayer ..... C25D 17/12 204/198
7,682,498 B1 3/2010 Mayer et al.
7,737,035 B1 6/2010 Lind et al.
7,837,841 B2 11/2010 Chen et al.
7,854,828 B2 12/2010 Reid et al.
7,967,969 B2 6/2011 Mayer et al.
8,262,871 B1 9/2012 Mayer et al.
8,308,931 B2 11/2012 Reid et al.
8,475,636 B2 7/2013 Mayer et al.
8,475,637 B2 7/2013 Mayer et al.
8,475,644 B2 7/2013 Feng et al.
8,603,305 B2 12/2013 Rash et al.
8,795,480 B2 8/2014 Mayer et al.
8,858,774 B2 10/2014 Mayer et al.
9,260,793 B2 2/2016 Mayer et al.
9,309,604 B2 4/2016 Mayer et al.
9,567,685 B2 2/2017 Kagajwala et al.
9,752,248 B2 9/2017 Kagajwala et al.
9,822,461 B2 11/2017 He et al.
2002/0017456 A1 2/2002 Graham et al.
2002/0020627 A1 2/2002 Kunisawa et al.
2002/0046952 A1 * 4/2002 Graham ..... C25D 7/12 205/99
2002/0119671 A1 8/2002 Lee
2002/0125141 A1 9/2002 Wilson et al.
2002/0195352 A1 12/2002 Mayer et al.
2003/0038035 A1 2/2003 Wilson et al.
2003/0079995 A1 * 5/2003 Contolini ..... C25D 17/008 205/118
2003/0168340 A1 * 9/2003 Kaja ..... C25D 17/007 205/96
2003/0201166 A1 10/2003 Zheng et al.
2004/0026257 A1 2/2004 Gonzalez, Jr. et al.
2004/0084316 A1 5/2004 Muranaka
2004/0094427 A1 5/2004 Economikos et al.
2004/0149584 A1 8/2004 Nagai et al.
2005/0109627 A1 5/2005 Sun et al.
2005/0145499 A1 7/2005 Kovarsky et al.
2005/0164498 A1 7/2005 Ide et al.
2006/0201814 A1 * 9/2006 Hafezi ..... C25D 5/04 205/102
2006/0243598 A1 11/2006 Singh et al.
2007/0029193 A1 2/2007 Brcka
2008/0179180 A1 7/2008 McHugh et al.
2008/0223724 A1 9/2008 Chen et al.
2010/0032303 A1 * 2/2010 Reid ..... C25D 17/002 205/96
2010/0032304 A1 2/2010 Mayer et al.
2010/0032310 A1 * 2/2010 Reid ..... C25D 21/12 205/261
2010/0044236 A1 * 2/2010 Mayer ..... C23C 18/1601 205/80
2010/0116672 A1 5/2010 Mayer et al.
2012/0000786 A1 1/2012 Mayer et al.
2012/0061246 A1 3/2012 Feng et al.
2012/0258408 A1 10/2012 Mayer et al.
2013/0137242 A1 5/2013 He et al.
2013/0313123 A1 11/2013 Abraham et al.
2013/0327650 A1 12/2013 Mayer et al.
2014/0231245 A1 8/2014 Sandmann et al.
2015/0060291 A1 3/2015 Mayer et al.
2016/0115611 A1 4/2016 Mayer et al.
2016/0177466 A1 6/2016 Kagajawala et al.
2016/0215408 A1 7/2016 Kagajawala et al.

FOREIGN PATENT DOCUMENTS

CN 1624207 A 6/2005
CN 1705774 A 12/2005
CN 101056718 A 10/2007
CN 100487855 C 5/2009
CN 101736376 A 6/2010
CN 102459717 B 12/2014
EP 1 179 617 A1 2/2002
JP H02-136062 U 11/1990
JP H04-143299 A 5/1992
JP H10-130896 A 5/1998
JP 2000-195823 A 7/2000
JP 2002-506488 A 2/2002
JP 2003-129294 A 5/2003
JP 2003-268591 9/2003
JP 2004-518817 A 6/2004
JP 2005-171317 A 6/2005
JP 2011-063849 A 3/2011
KR 10-0707121 4/2007
KR 10-2012-0029468 A 3/2012
TW 223678 11/2004
TW 201107536 A 3/2011
WO WO 99/14401 3/1999

(56) References Cited

FOREIGN PATENT DOCUMENTS

| | | |
|---|---|---|
| WO | WO 99/64647 | 12/1999 |
| WO | WO2004/009879 | 1/2004 |
| WO | WO2005/043593 | 5/2005 |
| WO | WO2010/144330 | 12/2010 |

OTHER PUBLICATIONS

U.S. Office Action, dated May 26, 2010, issued in U.S. Appl. No. 11/506,054.
U.S. Notice of Allowance, dated Aug. 13, 2010, issued in U.S. Appl. No. 11/506,054.
U.S. Office Action, dated Sep. 19, 2011, issued in U.S. Appl. No. 12/291,356.
U.S. Final Office Action, dated Feb. 27, 2012, issued in U.S. Appl. No. 12/291,356.
U.S. Notice of Allowance, dated Jul. 27, 2012, issued in U.S. Appl. No. 12/291,356.
U.S. Office Action, dated Jun. 24, 2011, issued in U.S. Appl. No. 12/481,503.
U.S. Final Office Action, dated Mar. 1, 2012, issued in U.S. Appl. No. 12/481,503.
U.S. Office Action, dated Jul. 9, 2012, issued in U.S. Appl. No. 12/481,503.
U.S. Final Office Action, dated Dec. 19, 2012, issued in U.S. Appl. No. 12/481,503.
U.S. Notice of Allowance dated Mar. 1, 2013 issued in U.S. Appl. No. 12/481,503.
U.S. Office Action, dated Jun. 24, 2011, issued in U.S. Appl. No. 12/606,030.
U.S. Final Office Action, dated Mar. 1, 2012, issued in U.S. Appl. No. 12/606,030.
U.S. Office Action, dated Jun. 28, 2012, issued in U.S. Appl. No. 12/606,030.
U.S. Office Action, dated Jul. 13, 2012, issued in U.S. Appl. No. 12/606,030.
U.S. Final Office Action, dated Dec. 17, 2012, issued in U.S. Appl. No. 12/606,030.
U.S. Notice of Allowance dated Mar. 1, 2013 issued in U.S. Appl. No. 12/606,030.
Chinese First Office Action dated May 15, 2013 issued in Application No. 200910209697.2.
PCT International Search Report and Written Opinion, dated Jan. 12, 2011, issued in PCT/US2010/037520.
PCT International Preliminary Report on Patentability and Written Opinion, dated Dec. 22, 2011, issued in PCT/US2010/037520.
U.S. Office Action, dated Nov. 9, 2016, issued in U.S. Appl. No. 14/578,068.
U.S. Office Action, dated Jun. 16, 2016, issued in U.S. Appl. No. 14/602,910.
U.S. Notice of Allowance, dated Oct. 6, 2016, issued in U.S. Appl. No. 14/602,910.
U.S. Office Action, dated Jul. 29, 2015, issued in U.S. Appl. No. 13/907,265.
U.S. Notice of Allowance, dated Dec. 30, 2015, issued in U.S. Appl. No. 13/907,265.
U.S. Office Action, dated Feb. 25, 2014, issued in U.S. Appl. No. 13/438,443.
U.S. Notice of Allowance, dated Jun. 11, 2014, issued in U.S. Appl. No. 13/438,443.
U.S. Notice of Allowance, dated Oct. 2, 2015, issued in U.S. Appl. No. 14/483,942.
U.S. Notice of Allowance [Corrected Notice of Allowability], dated Nov. 10, 2015, issued in U.S. Appl. No. 14/483,942.
U.S. Notice of Allowance [Corrected Notice of Allowability], dated Jan. 20, 2016, issued in U.S. Appl. No. 14/483,942.
U.S. Office Action, dated Jan. 15, 2016, issued in U.S. Appl. No. 13/687,937.
Chinese Second Office Action dated Dec. 10, 2013 issued in CN USSN 200910209697.2.
Chinese First Office Action dated Nov. 6, 2013 issued in CN USSN 201080032109.3.
Chinese Second Office Action dated Jun. 10, 2014 issued in CN USSN 201080032109.3.
Korean First Office Action dated Jun. 23, 2016 issued in KR 10-2012-7000614.
Taiwan Office Action dated Jul. 31, 2014 issued in TW USSN 099118603.
Chinese First Office Action dated Oct. 13, 2015 issued in CN 201210098129.1.
Chinese Second Office Action dated Jun. 6, 2016 issued in CN 201210098129.1.
Taiwan Office Action dated Nov. 10, 2015 issued in TW USSN 101111926.
Taiwan Office Action dated Aug. 2, 2016 issued in TW 101144354.
U.S. Notice of Allowance, dated May 3, 2017, issued in U.S. Appl. No. 14/578,068.
U.S. Final Office Action, dated May 1, 2017, issued in U.S. Appl. No. 13/687,937.
Taiwan Office Action dated Feb. 18, 2017 issued in Application No. TW 102142332.
Korean Second Office Action [no translation] dated Jan. 2, 2017 issued in Application No. KR 10-2012-7000614.
Chinese Third Office Action dated Nov. 18, 2016 issued in Application No. CN 201210098129.1.
Chinese First Office Action dated Mar. 31, 2017 issued in Application No. CN 201510556374.6.
U.S. Notice of Allowance [Corrected Notice of Allowability], dated Jun. 21, 2017, issued in U.S. Appl. No. 14/578,068.
U.S. Notice of Allowance, dated Aug. 1, 2017, issued in U.S. Appl. No. 13/687,937.
Chinese First Office Action dated Jul. 4, 2017 issued in Application No. CN 201610027064.X.
Chinese Fourth Office Action dated May 31, 2017 issued in Application No. CN 201210098129.1.
U.S. Office Action, dated Oct. 3, 2017, issued in U.S. Appl. No. 14/987,170.
Chinese Second Office Action dated Nov. 23, 2017 issued in Application No. CN 201510556374.6.
U.S. Appl. No. 15/787,580, filed Oct. 18, 2017, He et al.
Taiwan Second Office Action dated Nov. 29, 2017 issued in Application No. TW 102142332.
Japanese Office Action dated Nov. 28, 2017 issued in Application No. JP 2013-239467.

* cited by examiner

METHOD AND APPARATUS FOR DYNAMIC CURRENT DISTRIBUTION CONTROL DURING ELECTROPLATING

CROSS-REFERENCE TO RELATED APPLICATIONS

This application claims benefit of prior U.S. Provisional Application No. 61/730,285 filed Nov. 27, 2012, titled "Method and Apparatus for dynamic Current Distribution Control during Electroplating" naming Zhian He as the inventor, which is herein incorporated by reference in its entirety and for all purposes.

FIELD OF THE INVENTION

The present invention pertains to methods and apparatuses for electroplating. Specifically, the invention pertains to electroplating tools used for electrodeposition of metals in semiconductor processing.

BACKGROUND OF THE INVENTION

The transition from aluminum to copper in integrated circuit (IC) fabrication required a change in process "architecture" (to damascene and dual-damascene) as well as a whole new set of process technologies. One process step used in producing copper damascene circuits is the formation of a "seed-" or "strike-" layer, which is then used as a base layer onto which copper is electroplated (electrofill). The seed layer carries the electrical plating current from the edge region of the wafer (where electrical contact is made) to all trench and via structures located across the wafer surface. The seed film is typically a thin conductive copper layer. It is separated from the insulating silicon dioxide or other dielectric by a barrier layer. The use of thin seed layers having dual barrier-seed function (e.g. alloys of copper, or other metals, such as ruthenium and tantalum), has also been investigated.

As semiconductor industry advances, technology nodes are moving towards very thin and resistive seed regime for electrochemical fill. It becomes a very challenging problem to achieve uniform initial plating across the wafer with such resistive seed layers. To effectively plate a large surface area, the plating tool makes electrical contact to the conductive seed only in the edge region of the wafer substrate. There is no direct contact made to the central region of the substrate. Hence, for highly resistive seed layers, the potential at the edge of the layer is significantly greater than at the central region of the layer. Without appropriate means of resistance and voltage compensation, this large edge-to-center voltage drop could lead to an extremely non-uniform plating thickness distribution, primarily characterized by thicker plating at the wafer edge. This effect is known as terminal effect.

The non-uniform plating thickness will be even more pronounced as the industry transitions from 300 mm wafer to 450 mm wafer.

SUMMARY

The difficulty in controlling the terminal effect is further exacerbated by the fact that it is very pronounced in the beginning of electroplating when the seed layer on the wafer is most resistive, but is rapidly diminishing during the course of electroplating. As electroplating proceeds, the plated layer becomes thicker and more conductive, thereby reducing the terminal effect. Therefore, during a single electroplating process, very different ionic current environments should be created in the plating apparatus in order to compensate for the terminal effect in the beginning of the process, and to continue electroplating after the terminal effect has subsided.

The needs for controllable electroplating on resistive seed layers are addressed herein by providing an apparatus and a method for electroplating that make use of a focus ring (also referred to as an ionic current collimator) positioned in the proximity of an anode, and an auxiliary electrode with flexibly adjustable electrical characteristics. The ionic current collimator provides a resistive correction for the terminal effect by restricting the ionic current at the periphery, and by directing the ionic current to the central portions of the wafer substrate. However, the use of ionic current collimator alone would have resulted in unnecessarily center-thick plating. An auxiliary electrode residing around the ionic current collimator corrects this problem, by diverting the ionic current provided by the collimator away from the center, and modifying it to make it more uniform. In some embodiments, the auxiliary electrode is configured to serve as an auxiliary cathode in the beginning of the electroplating process, when the terminal effect is most pronounced, and is also configured to serve as an auxiliary anode (or even as a main anode) later in the process. The auxiliary electrode, in some embodiments, is configured to be able to accept a large amount of current (e.g., at least about 200% of the current supplied to the wafer in the beginning of electroplating, such as at least about 400% of the current supplied to the wafer in the beginning of electroplating), and is characterized by an unusual location in the electroplating apparatus. The auxiliary electrode, in some embodiments at least partially resides over the main anode, and has a non-zero footprint on the anode. In some embodiments, the auxiliary electrode is also characterized by a large surface area, which allows it to accept large currents without building excessively high current densities. For example, the auxiliary electrode in some embodiments is capable of accepting currents of between about 10-75 A, such as between about 20-50 A.

In one aspect, an apparatus for electroplating metal on a wafer substrate is provided. The apparatus comprises: (a) a plating vessel configured for holding an electroplating solution therein; (b) a wafer holder configured for holding the wafer substrate in position during electroplating, the wafer holder having one or more electrical power contacts arranged to contact an edge of the substrate and provide electrical current to the substrate during electroplating, wherein the apparatus is configured for cathodically biasing the wafer substrate during electroplating; (c) an anode (also referred to as "main anode") residing in the plating vessel and configured to be anodically biased during at least a portion of electroplating; (d) an ionic current collimator proximate the anode, wherein the ionic current collimator is a non-conductive member configured to direct the ionic current from the anode generally from the periphery to the center of the plating vessel; and (e) an auxiliary electrode configured to be both cathodically and anodically biased during electroplating.

In another aspect, a method for electroplating a layer of metal on a wafer substrate is provided. In some embodiments, the method involves (a) providing the wafer substrate to an electroplating apparatus having a wafer holder, and a plating vessel containing a main anode, an auxiliary electrode, and an ionic current collimator, wherein the ionic current collimator is configured to direct ionic current from the periphery to the center of the plating vessel; (b) in a first electroplating stage, electroplating metal onto the wafer substrate while cathodically biasing the auxiliary electrode; and (c) in a second electroplating stage, electroplating metal onto the wafer substrate while anodically biasing the auxiliary electrode.

In another aspect, a non-transitory computer readable medium comprising instructions for control of an electroplating apparatus is provided. The program instructions will include code for performing the methods provided herein, such as (a) in a first electroplating stage, electroplating metal onto the wafer substrate while cathodically biasing the auxiliary electrode; and (b) in a second electroplating stage, electroplating metal onto the wafer substrate while anodically biasing the auxiliary electrode.

These and other features and advantages of the present invention will be described in more detail below with reference to the associated drawings.

DETAILED DESCRIPTION

Figure 1A:
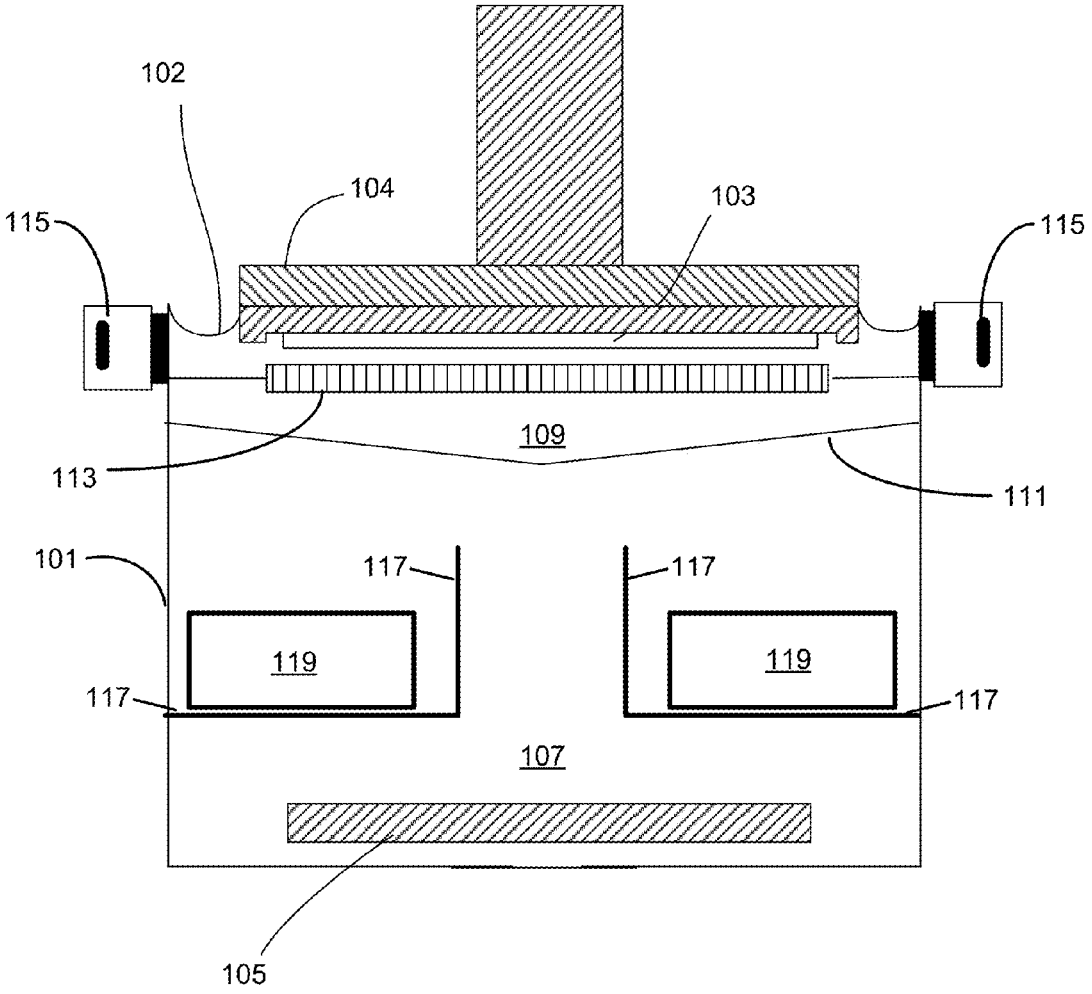
FIG. 1A is a schematic cross-sectional view of an electroplating apparatus in accordance with an embodiment presented herein.

The methods and apparatus provided herein are useful for electroplating a variety of metals including but not limited to copper and its alloys on semiconductor substrates having one or more recessed features (e.g., trenches and vias). The methods and apparatus are useful for electroplating on 300 mm and, particularly, on 450 mm semiconductor wafers and on resistive seed layers. For example, the apparatus and methods, can be used, in some embodiments, for electroplating on seed layers having seed sheet resistance of up to about 50 Ohm/sq. (inclusive of this number), e.g. with sheet resistance of between about 10-50 Ohm/sq., such as between about 20-40 Ohm/sq. Examples of substrates that can be processed by provided methods include, without limitation, a 300 mm wafer having a copper seed layer having a thickness of between about 10-2000 Å, or a 450 mm wafer having a copper seed layer having a thickness of between about 20-2000 Å. In some embodiments the initial copper seed layer thickness is between about 10-100 Å, e.g., between about 10-50 Å.

The methods and apparatus described herein can be used to provide plated layers having excellent center-to-edge uniformity due to their high capability for controlling ionic current environment within the electroplating bath. While in many implementations uniform plating is desired, in some embodiments, when center-thick or edge-thick plating is required, the apparatus can be configured to control ionic current distribution such as to introduce the desired non-uniformity.

In one aspect, an apparatus for electroplating is provided. The apparatus comprises: (a) a plating vessel configured for holding an electroplating solution therein; (b) a wafer holder configured for holding the wafer substrate in position during electroplating, the wafer holder having one or more electrical power contacts arranged to contact an edge of the substrate and provide electrical current to the substrate during electroplating, wherein the apparatus is configured for cathodically biasing the wafer substrate during electroplating; (c) an anode residing in the plating vessel (also known as the main anode); (d) an ionic current collimator proximate the anode, wherein the ionic current collimator is a non-conductive member configured to direct the ionic current from the anode generally from the periphery to the center of the plating vessel; and (e) an auxiliary electrode configured to be both cathodically and anodically biased during electroplating.

The ionic current collimator is made of dielectric material (e.g., plastic) that is not permeable to electrolyte. Examples of suitable materials include polycarbonate, polyethylene, polypropylene, polyvinylidene difluoride (PVDF), polytetrafluoroethylene, and polysulphone. In some embodiments the ionic current collimator comprises two portions: (i) the central portion which is generally in the form of an open cylinder extending in the direction that is perpendicular to the plane of the wafer substrate (referring to the plane of the plating surface of the substrate), and, typically, co-centered with the center of the wafer substrate and the center of the anode, where the openings of the cylinder provide a route for the ionic current; and (ii) the current restricting portion which is connected to the cylindrical portion, e.g., at the end of the cylindrical portion that is proximate the anode, and which is generally parallel to the plane of the wafer substrate. The current restricting portion typically extends to the sidewalls of the plating vessel and is secured (e.g., attached) to these walls such that the ionic current collimator is held in place, and such that the ionic current from the anode would not be able to escape at the periphery of the plating vessel. Thus, the ionic current collimator can direct substantially all of the current from the main anode through its central cylindrical opening generally in the direction of the center of the wafer. The ionic current collimator, in some embodiments, does not contact the anode and is spaced apart from the anode by at least about 15% of the wafer radius (e.g., by at least about 40 mm), for example by around 60 mm. The spacing from the anode determines the amount of anode utilization, and also impacts the thickness or current density profile. For example, if the collimator is too close to the anode, the anode utilization may be relatively small.

In some embodiments, the ionic current collimator is stationary, and does not move during electroplating.

In other embodiments, the apparatus is configured to move the ionic current collimator along an axis that is perpendicular to the plane of the wafer substrate. For example, the collimator can be moved closer to the wafer when more ionic current at the wafer center is desired, and can be moved away from the wafer when less center-focused current is needed. In some implementations, the apparatus includes a mechanism configured for moving the ionic current collimator. For example, the collimator can be moved with a bellows-type mechanism.

The auxiliary electrode is located between the anode and the wafer substrate or the wafer substrate holder (referring to a position on an axis that is perpendicular to the wafer surface), and further away from the anode than the current-restricting portion of the collimator. In some embodiments, the current-restricting portion of the collimator serves as a convenient platform on which the auxiliary electrode resides in the electroplating apparatus. The auxiliary electrode is electrically connected to a power supply and can be biased negatively or positively, as desired. When biased negatively, the auxiliary electrode serves as an auxiliary cathode and is capable of diverting ionic current toward itself, thereby reducing the current experienced by the wafer substrate, and redistributing the center-focused current exiting the cylindrical portion of the collimator. When biased positively, the auxiliary electrode serves as an anode and is capable of providing additional ionic current to the wafer. The auxiliary electrode is typically made of the same material that is being electroplated. For example, when copper is electrodeposited on the wafer substrate, a copper auxiliary electrode is used, and serves as a source of copper ions when the auxiliary electrode serves as an anode. In some embodiments, the auxiliary electrode has a core made of any suitable metal and has a coating of the metal that is being plated (e.g., copper coating). The coating may be pre-made, or can be generated during initial stages of electroplating, when the auxiliary electrode serves as a cathode (due to electrodeposition on the cathodically biased auxiliary electrode).

Other important characteristics of the auxiliary electrode are its unusual location and its size. In some embodiments, the auxiliary electrode is located not beyond the circumference of the anode, but relatively closer to the center of the plating bath, and around the opening of the current collimator. In such stacked configuration, utilization of the surfaces for both the main anode and the auxiliary electrode would be greater compared to an arrangement in which the anode and the auxiliary electrode reside in the same plane. The ability to utilize greater surface areas, allows the use of high currents for both the main anode and the auxiliary electrode without building unnecessarily high current densities on these electrodes. This is a significant advantage, because plating on resistive seed layers often calls for the use of very high currents.

In some embodiments, the footprint of the auxiliary electrode projected onto the anode is at least about 40% of the total anode area, e.g., between about 60 and 80% of the total anode area. Such position of the auxiliary electrode allows for efficient use of the auxiliary electrode both in an anode mode and for redistribution of central current from the collimator. Further, in some embodiments the auxiliary electrode has a large surface area. When the surface area is large, the auxiliary electrode can accept a very high current (as often needed to compensate for the terminal effect caused by highly resistive seed layers), without building undesirably high current densities. In some embodiments, the working surface area of the auxiliary electrode (the area that is in contact with electrolyte) is at least about 600 $cm^2$, such as between about 900 $cm^2$ and 1200 $cm^2$. In some embodiments, the auxiliary electrode has a generally toroidal shape, having a thickness (difference between outer and inner radius) that is at least about 20 mm, such as between about 20 mm and 80 mm. For example, the difference between the outer and inner radius, in some embodiments is at least about 5% of the wafer radius, such as between about 8-40% of the wafer radius.

In some embodiments the auxiliary electrode is stationary. In other embodiments the auxiliary electrode is configured to be movable along an axis that is perpendicular to the plane of the wafer substrate. The auxiliary electrode can be moved together with a movable ionic current collimator, or separately from the collimator. For example, the auxiliary electrode in an anode mode can be moved closer to the wafer, in order to provide more plating current to the center of the wafer. In some embodiments, the electroplating apparatus includes a mechanism configured for moving the auxiliary electrode (e.g., a bellows-like mechanism).

In addition to the ionic current collimator and the auxiliary electrode, the electroplating apparatus may further include additional elements that are useful for mitigating the terminal effect. In some embodiments the apparatus further includes an ionically resistive element having electrolyte-permeable pores or holes, where the element resides in close proximity of the wafer substrate (e.g., within about 5 mm of platable surface of the wafer). The ionically resistive ionically permeable element is useful for improving plating uniformity on thin resistive seed layers. The ionically resistive ionically permeable element presents a uniform current density in the proximity of the wafer cathode and therefore serves as a virtual anode. Accordingly, the ionically resistive ionically permeable element is also referred to as a high-resistance virtual anode (HRVA)

In certain embodiments, the HRVA is located in close proximity to the wafer. In certain embodiments, the HRVA contains a plurality of through-holes that are isolated from each other and do not form interconnecting channels within the body of HRVA. Such through-holes will be referred to as 1-D through-holes because they extend in one dimension, typically, but not necessarily, normal to the plated surface of the wafer. These through-holes are distinct from three-dimensional porous networks, where the channels extend in three dimensions and form interconnecting pore structures. An example of a HRVA is a disk made of an ionically resistive material, such as polycarbonate, polyethylene, polypropylene, polyvinylidene difluoride (PVDF), polytetrafluoroethylene, polysulphone and the like, having between about 6,000-12,000 1-D through-holes. In other embodiments, the HRVA is a porous structure in which at least some of the pores are interconnected and therefore allow some two- or three-dimensional movement of electrolyte therein. The disk, in many embodiments, is substantially coextensive with the wafer (e.g., has a diameter of about 300 mm when used with a 300 mm wafer) and resides in close proximity of the wafer, e.g., just below the wafer in a wafer-facing-down electroplating apparatus. In some embodiments, the disk is relatively thin, for example between about 5 and 50 mm thick. The plating electrolyte contained within the pores of the HRVA allows ionic current to pass though the disk, but at a significant voltage drop compared to the system as a whole. For example, the voltage drop in the HRVA may be greater than about 50%, for example, between about 55 and 95%, of the total voltage drop between the counter electrode (anode) and the wafer peripheral edge. In certain embodiments, the plated surface of the wafer resides within about 10 mm, and in some embodiments, within about 5 mm, of the closest HRVA surface.

Further, in some embodiments the apparatus includes a secondary cathode, which is typically located at the periphery of the wafer substrate (e.g., having no footprint projected to the wafer). This secondary cathode, also referred to as a thieving cathode is negatively biased during at least a portion of electroplating and is configured to divert at least a portion of ionic current from the wafer periphery, thereby reducing plated thickness at the very edge of the wafer.

The apparatus will further include one or more power supplies and a controller in association with the power supplies and with the elements of the apparatus, wherein the controller is configured to perform the methods described herein. For example the controller may include instructions (e.g., in the form of program instructions or pre-built logic blocks) to specify electrical characteristics (e.g., current, voltage, power, polarity) provided to one or more components selected from the group consisting of the wafer substrate, the auxiliary electrode, an anode, and the secondary (thief electrode). The instructions may be provided in some embodiments, by time—characteristic sequences (e.g., time-current sequences) for each of the elements.

In some embodiments, the main anode is located in a separated anode chamber, while the wafer substrate is located in a cathode chamber, wherein the two chambers are separated by an ion-permeable membrane (e.g., a Nafion® membrane). The compositions of electrolyte in the anode and cathode chambers may be different. For example, catholyte in the cathode chamber may contain organic plating additives, while the anolyte is free of organic additives. In one configuration, the ionic current collimator and the auxiliary electrode are located in the separated anode chamber.

In some embodiments, the auxiliary electrode is also separated from the anode by a cationic membrane such as a Nafion® membrane, while remaining in ionic communication with the electrolyte (e.g. anolyte). For example, the auxiliary electrode may reside in a chamber defined by the walls of the current collimator, the walls of the plating vessel, and the cationic membrane. The membrane preferably does not allow particulate material, which may form at the electrode due to flaking, to travel across the membrane. The use of a membrane to isolate the auxiliary electrode can lead to electroplating with fewer defects.

In another aspect, a method for electroplating a layer of metal on a wafer substrate is provided. In some embodiments, the method involves (a) providing the wafer substrate to an electroplating apparatus having a wafer holder, and a plating vessel containing a main anode, an auxiliary electrode, and an ionic current collimator, wherein the ionic current collimator is configured to direct ionic current from the periphery to the center of the plating vessel; (b) in a first electroplating stage, electroplating metal onto the wafer substrate while cathodically biasing the auxiliary electrode; and (c) in a second electroplating stage, electroplating metal onto the wafer substrate while anodically biasing the auxiliary electrode.

Electroplating is performed by making one or more electrical contacts at the periphery of the wafer substrate, wherein the contacts are made to the conductive seed layer residing on the wafer substrate and by negatively biasing the wafer substrate, so that it serves as a main cathode. In the beginning of the plating, the seed layer on the substrate is highly resistive and initially a relatively large current should be applied to a negatively biased auxiliary electrode. Typically, the cathodic current initially applied to the auxiliary electrode is at least about 200%, such as at least about 300%, more preferably at least about 500%, such as between about 400-600% of the cathodic current applied to the wafer substrate. For example, when between about 10-15 A current is applied to the wafer, between about 50-75 A is applied initially to the auxiliary electrode (functioning as a cathode). In some embodiments, the cathodic current initially applied to the auxiliary electrode is between about 10-75 A, such a s between about 20-50 A. As plating proceeds and the terminal effect subsides, the cathodic current applied to the auxiliary electrode is reduced, in some embodiments. Reduction of cathodic current to the auxiliary electrode can follow a number of current vs. time functions, e.g., over time the current can be reduced linearly, exponentially, or follow a polynomial function. After the reduction, the auxiliary electrode is biased positively and starts serving as an auxiliary anode. In some embodiments the current supplied to the auxiliary electrode (now in anode mode) is increased over time. In some embodiments the auxiliary electrode at least during a portion of electroplating time receives more anodic current than the main anode, thereby essentially serving as the main anode in the system. In some embodiments, when the auxiliary electrode is anodically biased, the main anode (which was anodically biased in the beginning of plating), is switched to being biased cathodically and remains cathodically biased at least for a portion of electroplating. In some embodiments, in order to compensate for the very strong terminal effect in the beginning of the plating, the plating tool may be configured to favor plating in the center of the wafer at the beginning of electroplating. For example, in a plating apparatus the electrical path from the anode to the edge of the wafer is configured to be more resistive than the electrical path to the center of the wafer. In some embodiments, as plating proceeds, and terminal effect diminishes, electroplating rate in the center of the wafer can become too fast thereby having the potential to cause current density non-uniformity across the wafer. In such cases, the current provided by the auxiliary electrode (which acts as an anode in the second stage of electroplating) will be increased with time and the current provided by the main anode will be decreased with time. In some cases, where the plating apparatus provides particularly large amounts of plating current at the center of the wafer, the main anode is switched to be biased cathodically in order to help further reduce the center-thick plating and to keep uniform current density distribution across the whole wafer. In such cases, the main anode acts as a centrally based secondary cathode during a portion of electroplating, e.g., during at least a portion of the second stage of electroplating.

In some embodiments, the methods provided herein involve moving the ionic current collimator along an axis that is perpendicular to the plane of the wafer substrate during electroplating. In some embodiments, the methods provided herein involve moving the auxiliary electrode along an axis that is perpendicular to the plane of the wafer substrate during electroplating. The ionic current collimator and the auxiliary electrode in some embodiments are moved together in one block. In other embodiments, the auxiliary electrode is moved separately from the collimator.

In some embodiments, in addition to the ionic current collimator and the auxiliary electrode, the electroplating apparatus further includes additional elements that are useful for mitigating the terminal effect. In some embodiments, an ionically resistive ionically permeable member, also known as HRVA resides between the anode and the wafer substrate. The auxiliary electrode preferably resides between the HRVA and the anode in the plating chamber. In some embodiments, the apparatus further includes a secondary cathode, which is typically located at the periphery of the wafer substrate (e.g., having no footprint projected to the wafer). This secondary cathode, also referred to as a thieving cathode is negatively biased during at least a portion of electroplating and is configured to divert at least a portion of ionic current from the wafer periphery, thereby reducing plated thickness at the very edge of the wafer. In some embodiments provided methods comprise providing a cathodic current to the secondary cathode, wherein the current is between about 100-400%, more preferably is between about 200-300% of the current provided to the wafer substrate at the beginning of electroplating. As electroplating proceeds, the current supplied to the secondary cathode may be reduced, e.g., to zero, or to a small constant current.

The use of a flexible auxiliary electrode, where the flexibility refers to its ability to function both as a cathode and an anode, and to be able to follow a number of current-time routines as desired by the user, allows for efficient control of ionic current distribution during the entire course of electroplating. Thereby, uniformly plated metal layers can be obtained even when highly resistive seed layers are used or when large wafers (e.g., 450 mm wafers) are used. The auxiliary electrode and the ionic current collimator work in synergy to mitigate terminal effect. The collimator directs the ionic current from the periphery generally in the central direction, thereby reducing the terminal effect. In the presence of the collimator a relatively smaller current can be provided to the auxiliary electrode (in a cathode mode) at the beginning of electroplating, to achieve mitigation of terminal effect. In addition, in some embodiments, the ionic current collimator provides an efficient platform in the plating chamber for a large auxiliary electrode.

The apparatus and process described hereinabove may be used in conjunction with lithographic patterning tools or processes, for example, for the fabrication or manufacture of semiconductor devices, displays, LEDs, photovoltaic panels and the like. Typically, though not necessarily, such tools/processes will be used or conducted together in a common fabrication facility. Lithographic patterning of a film typically comprises some or all of the following steps, each step enabled with a number of possible tools: (1) application of photoresist on a workpiece, i.e., substrate, using a spin-on or spray-on tool; (2) curing of photoresist using a hot plate or furnace or UV curing tool; (3) exposing the photoresist to visible or UV or x-ray light with a tool such as a wafer stepper; (4) developing the resist so as to selectively remove resist and thereby pattern it using a tool such as a wet bench; (5) transferring the resist pattern into an underlying film or workpiece by using a dry or plasma-assisted etching tool; and (6) removing the resist using a tool such as an RF or microwave plasma resist stripper. In some embodiments, the electroplating methods provided herein further include lithographic steps of: applying photoresist to the workpiece; exposing the photoresist to light; patterning the resist and transferring the pattern to the workpiece; and selectively removing the photoresist from the work piece. In some embodiments, a system is provided which includes the electrodeposition apparatus described herein and a stepper.

Another aspect of the invention is an apparatus configured to accomplish the methods described herein. A suitable apparatus includes hardware for accomplishing the process operations and a system controller having instructions for controlling process operations in accordance with the present invention. The system controller will typically include one or more memory devices and one or more processors configured to execute the instructions so that the apparatus will perform a method in accordance with the present invention. Machine-readable media containing instructions for controlling process operations in accordance with the present invention may be coupled to the system controller. In some embodiments, an apparatus is provided, wherein the apparatus comprises a plating vessel, a wafer holder, an auxiliary electrode, an ionic collimator and a controller comprising program instructions and/or built in logic for (a) in a first electroplating stage, electroplating metal onto the wafer substrate while cathodically biasing the auxiliary electrode; and (b) in a second electroplating stage, electroplating metal onto the wafer substrate while anodically biasing the auxiliary electrode.

Advanced technologies call for the electroplating of metals onto wafers with sheet resistances of 10 ohm per square and higher (even 20 ohms per square or 40 ohms per square or higher). As seed layers gets thinner, and as wafer sizes get bigger, the difference in plating thickness between the center and edge (thus terminal effect) becomes more pronounced. This requires ever more aggressive techniques to compensate for the terminal effect. During plating, the thickness of metal and the sheet resistance can drop several orders of magnitude in a short time, and so methods and apparatus capable of plating uniformly on the wafer throughout a process where there may be a rapidly initially varying and later a relatively constant sheet resistance are required. Embodiments of the present invention address the challenges presented by such high resistance seed layers, the rapid dynamic variance in the seed electrical parameters, and the extreme terminal effect they present.

Embodiments of the present invention pertain to methods and apparatuses for electroplating a substantially uniform layer of metal onto a work piece having a seed layer thereon. In certain embodiments, a plating cell includes both an ionic current collimator positioned in the proximity of an anode, and an auxiliary electrode configured to function as an auxiliary cathode in the beginning of electroplating and as an auxiliary anode at later stages of electroplating. The described configuration, particularly when used in combination with a HRVA and a secondary cathode, can maintain uniform current distribution throughout plating process. In some cases, however, it may be desirable to use embodiments of the invention to create a non-uniform current density that is experienced by the wafer. For example, it may be desirable to create a non-uniform current density, resulting in non-uniform metal plating, during overburden deposition to aid in chemical mechanical polishing (CMP), wet chemical etching, electropolishing, or electromechanical polishing.

A cross-sectional schematic view of an example of an electroplating apparatus having an ionic current collimator and a flexible auxiliary electrode is shown in FIG. 1A. Electrical connectivity is not shown to preserve clarity The apparatus depicted in FIG. 1A includes a plating vessel 101, which is configured to hold electrolyte 102 (e.g.

an aqueous solution of a copper salt, an acid, and electroplating additives) in contact with the wafer substrate 103 during electroplating. The wafer substrate 103 is held in a face-down orientation by the wafer holder 104. The wafer holder includes electrical contacts that are configured to contact the wafer 103 at its periphery (but not in the center), which are electrically connected to a power supply (not shown). In some embodiments, the wafer holder 104 is a clamshell apparatus which makes contacts to the periphery of the wafer through a number of contact fingers housed behind a typically elastic "lip seal", which serves to seal the clamshell and keep the edge contact region and wafer backside substantially free of electrolyte, as well as to avoid any plating onto the contacts. A general description of a clamshell-type plating apparatus having aspects suitable for use with this invention is described in detail in U.S. Pat. No. 6,156,167 issued to Patton et al., and U.S. Pat. No. 6,800,187 issued to Reid et al, which are both incorporated herein by reference for all purposes. The wafer holder is also configured to rotate the wafer substrate during electroplating.

The apparatus is configured to negatively bias the wafer substrate during electroplating such that it serves as a cathode. The electroplating vessel 101 further includes an anode 105, located at a distance below the wafer substrate. The anode is electrically connected to a power supply and is configured to be positively biased relative to the wafer substrate during plating (e.g., it can be held at a ground potential). An active anode (e.g. copper-containing anode) is typically used. For applications used for deposition of other metals either an active anode or an inert anode could be used. It is noted that in some embodiments, the main anode 105 may also be configured to serve as a cathode during some stages of electroplating (e.g., when the auxiliary electrode assumes an anodic function). In these embodiments, the main anode is connected with one or more power supplies that are capable of biasing it both anodically and cathodically.

In the depicted embodiment, the apparatus includes an anode chamber 107 and a cathode chamber 109, which are separated by an ion-permeable membrane 111. A cationic membrane, such as Nafion may be used as a membrane 111. The composition of electrolyte in the anode chamber 107 and in the cathode chamber 111 may be the same or different. In some embodiments, the electrolyte in the anode chamber (anolyte) contains ions of plateable metal, but no organic plating additives, while the electrolyte in the cathode chamber (catholyte) contains both ions of plateable metal and organic plating additives (e.g., one or more of accelerators, suppressors, and levelers). The cationic membrane 111 allows ionic communication between the separated anolyte chamber and the cathode chamber, while preventing the particles generated at the anode from entering the proximity of the wafer and contaminating it. The cationic membrane is also useful in prohibiting non-ionic and anionic species such as bath additives from passing though the membrane and being degraded at the anode surface, and to a lesser extent in redistributing current flow during the plating process and thereby improving the plating uniformity. Detailed descriptions of suitable ionic membranes are provided in U.S. Pat. Nos. 6,126,798 and 6,569,299 issued to Reid et al., both incorporated herein by reference. A detailed description of suitable cationic membranes is provided in U.S. patent application Ser. No. 12/337,147, entitled Electroplating Apparatus with Vented Electrolyte Manifold, filed Dec. 17, 2008, incorporated herein by reference. Further detailed description of suitable cationic membranes is provided in U.S. Patent Application Ser. No. 61/139,178, entitled Plating Method and Apparatus with Multiple Internally Irrigated Chambers, filed Dec. 19, 2008, incorporated herein by reference.

An ionically resistive ionically permeable element 113 (also known as HRVA) is located directly below the wafer 103 and resides in the cathode chamber 109. HRVA, in some embodiments, is a plate made of a dielectric material, which has a plurality of non-communicating holes, which provide a resistive path for ionic current in the proximity of the substrate. HRVA is described in detail in the US Patent Pub. No. 2010/0116672 by Mayer et al. titled Method and Apparatus for Electroplating, filed Jun. 9, 2009, incorporated herein by reference.

A thieving secondary cathode 115 resides in this embodiment in its own chamber filled with electrolyte and is in ionic communication with electrolyte in the cathode chamber. The secondary cathode 115 is electrically connected to a power supply and is configured to be negatively biased at least during a portion of electroplating. The opening of the chamber, which defines the virtual thief cathode is located between the HRVA 113 and the wafer 103, referring to position on the vertical axis. This location allows for efficient diversion of ionic current from the near edge region of the wafer. A thief cathode (both physical and virtual) in this location is described in detail in the U.S. patent application Ser. No. 12/481,503, previously incorporated by reference. In some embodiments the thief cathode is a metal ring peripherally located relative to the wafer substrate.

Referring again to FIG. 1, the anode chamber 107 houses the ionic current collimator 117 and an auxiliary electrode 119. The ionic current collimator 117 is located above the anode 105. The current collimator has a current restricting portion generally parallel to the plane of the anode, and attached to the walls of the plating chamber, and a cylindrical central portion which is generally in the form of an open cylinder extending in the direction that is perpendicular to the plane of the wafer substrate, and, typically, co-centered with the center of the wafer substrate and the center of the anode. The openings of the cylinder provide a route for the ionic current to move from the anode upward in the direction of the wafer substrate. The current collimator as a whole directs the current from the anode in the direction of central portions of the wafer, and thereby provides a resistive compensation for the terminal effect. However, this compensation alone is not sufficient for plating on highly resistive seed layers. Accordingly, an auxiliary electrode configured to redistribute the current from the opening of the collimator, away from the center of the wafer is needed.

The auxiliary electrode 119 in the depicted embodiment resides on top of the current-restricting portion of the ionic current collimator 117. The auxiliary electrode 119 is electrically connected to a power supply and is configured to be biased both cathodically and anodically during the course of electroplating of a single substrate. In some embodiments, the auxiliary electrode is negatively biased in the beginning of electroplating, when the terminal effect is pronounced, and later is anodically biased. Because the auxiliary electrode serves as an anode, in some embodiments it is made of a material that is plated on the wafer substrate, e.g., copper during copper plating. In other embodiments, it has a coating of a metal that is being plated on the substrate and a core made of a different metal. Yet in other embodiments the auxiliary electrode may be made of a material that is different from the one being plated, but it is sufficiently coated with the plated metal (e.g., copper) during the period when it serves as a cathode. This deposited material is then redissolved when the auxiliary electrode serves as an anode.

Figure 1B:
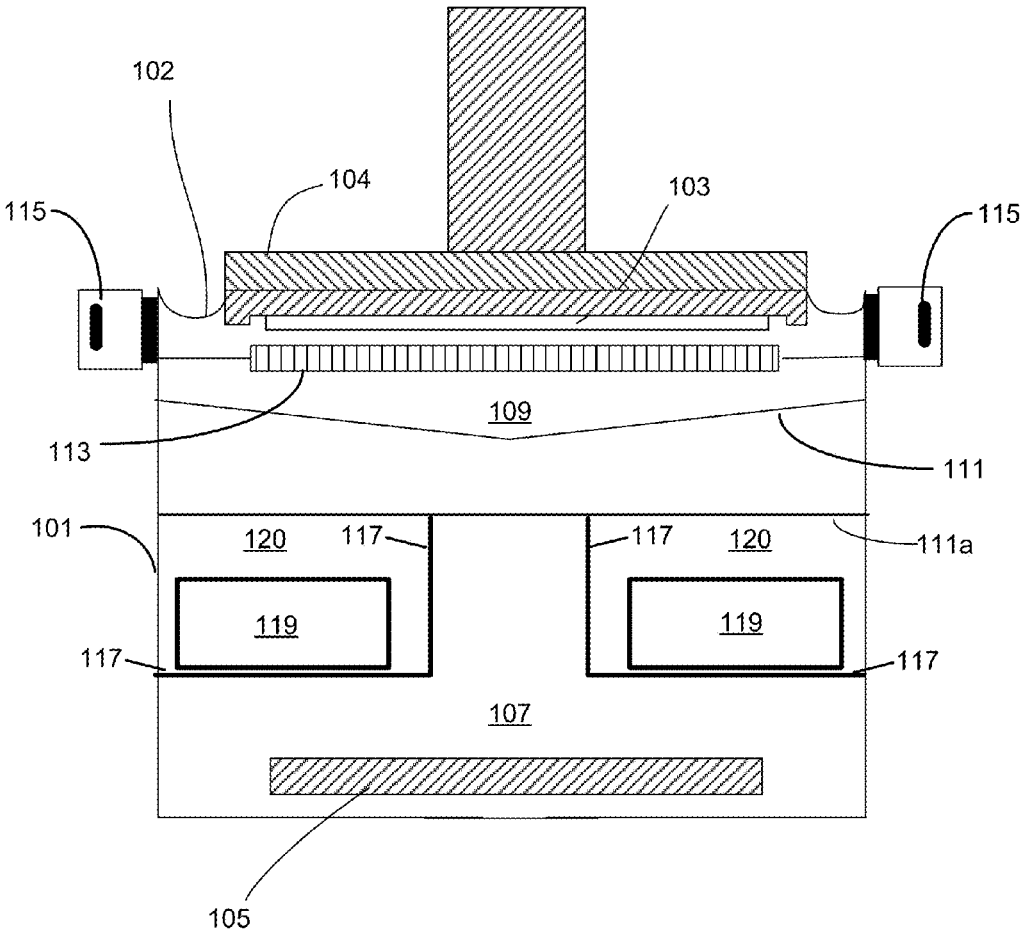
FIG. 1B is a schematic cross-sectional view of an electroplating apparatus in accordance with another embodiment presented herein.

A cross-sectional schematic view of another example of an electroplating apparatus having an ionic current collimator and an auxiliary electrode is shown in FIG. 1B. In this apparatus, in addition to the cationic membrane 111 residing below the HRVA, a second cationic membrane 111*a* is added, such that the membrane 111*a* resides directly above the auxiliary electrode 119, so that a chamber 120 is formed. The auxiliary electrode chamber 120 is defined by the sidewall of the apparatus on one side, by the ionic current collimator 117 on the bottom and on the other side and by the cationic membrane 111*a* on top. The cationic membrane 111*a* separates the auxiliary electrode from the anode, such that any particles generated at the auxiliary electrode, would not be able to cross the membrane. The membrane, however, allows for ionic communication between the auxiliary electrode chamber and anolyte, as the cationic membrane allows for transfer of cations. The cationic membrane 111*a* is attached to the sidewalls of the plating vessel, and is typically also attached to the opening of the cylinder of the ionic current collimator 117 (e.g., by an o-ring). The auxiliary electrode may be prone to flaking, due to plating and deplating cycles, and therefore its isolation via a cationic membrane is preferred in some embodiments.

Figure 1C:
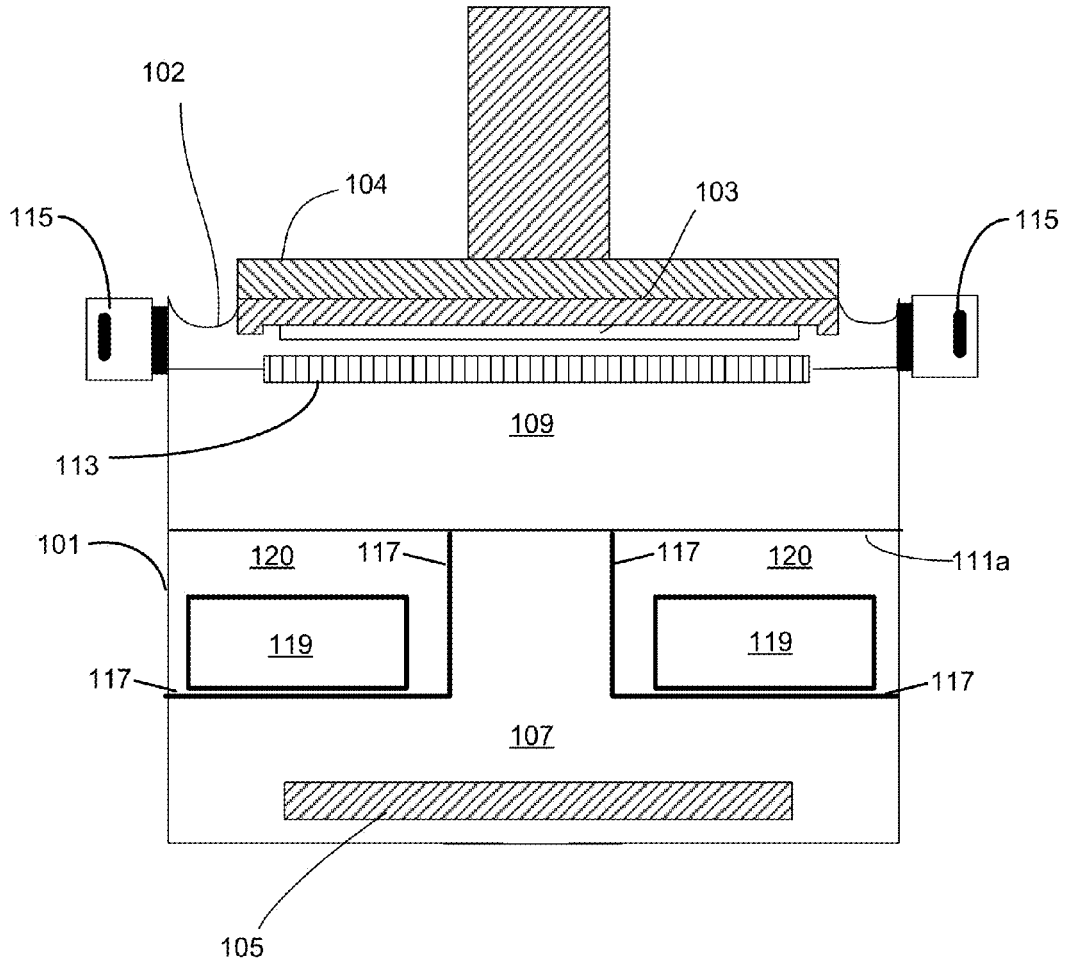
FIG. 1C is a schematic cross-sectional view of an electroplating apparatus in accordance with another embodiment presented herein.

A cross-sectional schematic view of yet another example of an electroplating apparatus having an ionic current collimator and a flexible auxiliary electrode is shown in FIG. 1C. In this implementation, the cationic membrane 111*a* isolating the auxiliary electrode 119 in a chamber 120 is present, but the cationic membrane 111 in the proximity of the HRVA is absent.

The relative positions of the ionic current collimator and of the auxiliary electrode are significant characteristics of the described apparatus. The ionic current collimator and the auxiliary electrode work in synergy to provide a flexible solution for modulating ionic current distribution and, consequently, for plating uniformity during the course of electroplating under changing conditions.

Figure 2A:
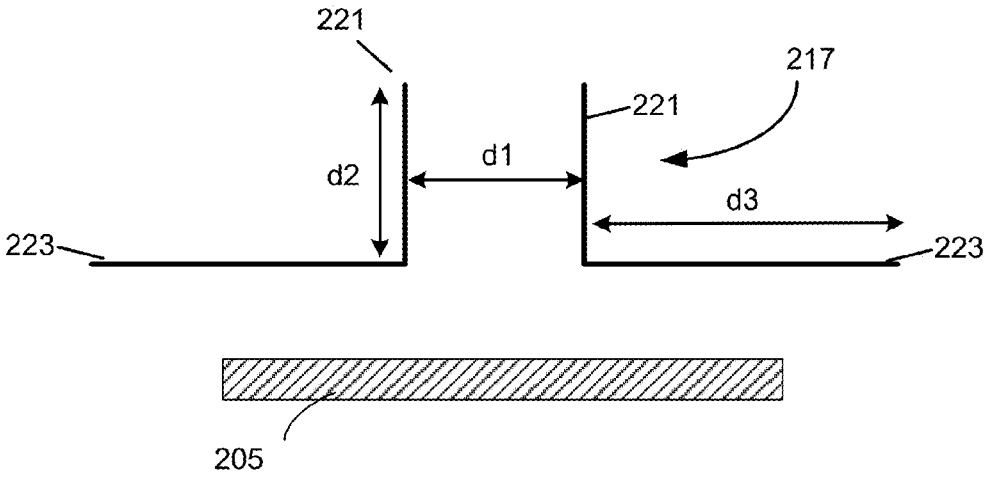
FIG. 2A is a schematic cross-sectional view of an ionic current collimator residing over an anode.

The current collimator is described in more detail with reference to FIGS. 2A and 2B. FIG. 2A shows a diagrammatical cross-sectional view of the ionic current collimator 217 residing over the anode 205. The central portion 221 of the ionic current collimator 217 is a hollow cylinder having a diameter d1 and height d2. In some embodiments the diameter d1 is between about 30-70% of the wafer radius, more preferably between about 40-60% of the wafer radius, such as between about 90-135 mm. The height d2 can be between about 30-60% of d1, in some embodiments. The central portion of the ionic current collimator is attached to the current restricting portion 223, where the current restricting portion 223 is parallel to the anode. The current restricting portion extends to the walls of the plating vessel and has a length d3 of between about 30-70% of the wafer radius. The ionic current collimator is positioned such that it restricts the ionic current from escaping at the periphery and directs substantially all current from the anode to the opening of the cylinder in the central portion 221. The top surface of the collimator and the HRVA bottom surface are maintained at a non-zero distance to allow for current redistribution to the auxiliary electrode. In some embodiment this distance is less than half of the wafer radius.

In some embodiments the ionic current collimator does not have two distinct portions described above, but simply has an ion restricting portion with an opening in the center. The ionic current collimator in these embodiments may have a toroidal shape with a uniform thickness (along an axis perpendicular to the wafer surface). However, an embodiment of collimator with a central cylindrical portion extending upward towards the wafer has a number of advantages over a simpler doughnut-shaped collimator. For example, the collimator having a central cylindrical portion extending upward is typically more effective in delivering the ionic current to the central portions of the wafer, and also serves as a more convenient platform for the auxiliary electrode.

Figure 2B:
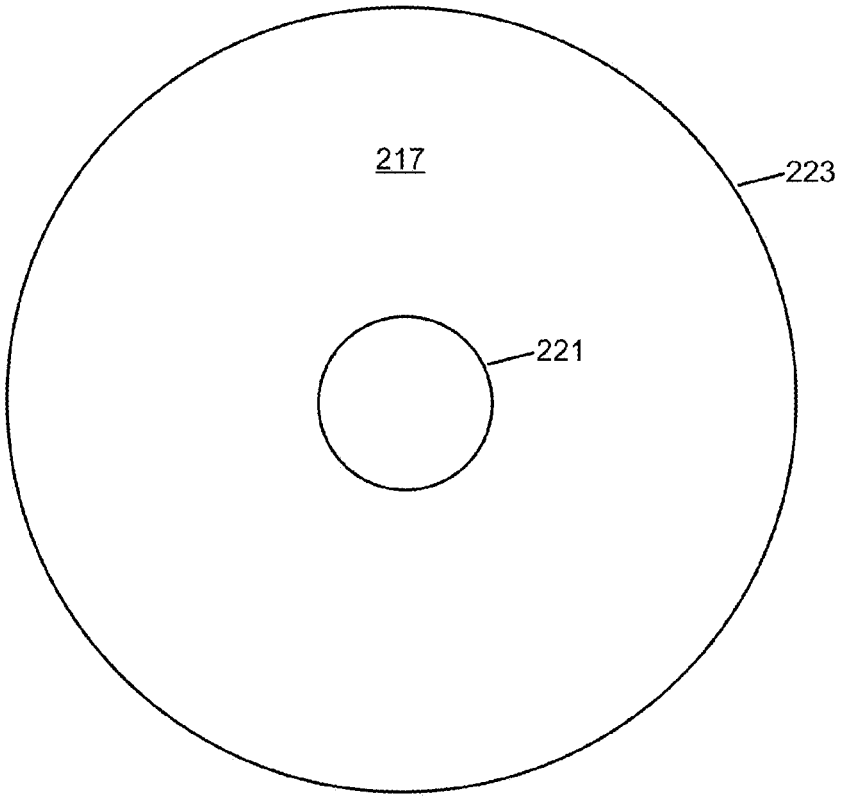
FIG. 2B is a schematic top view of an ionic current collimator.

FIG. 2B illustrates a top view of the ionic current collimator 217, showing an extended disk of the current restricting portion 223 around the opening of the central portion 221.

Figure 3A:
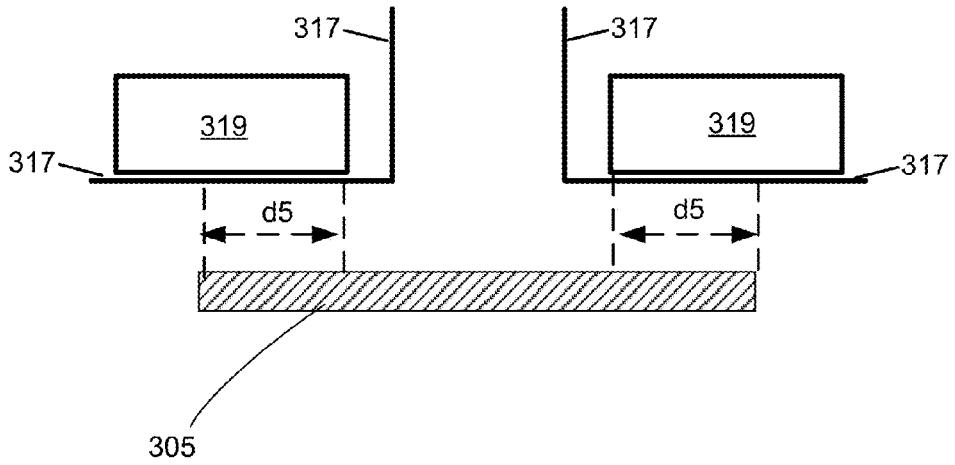
FIG. 3A is a schematic cross-sectional view of an auxiliary electrode, an ionic current collimator and an anode in accordance with an embodiment presented herein.

FIG. 3A illustrates a cross-sectional schematic view of a portion of the electroplating apparatus which includes the anode 305, the current collimator 317, and the auxiliary electrode 319 which resides on the current restricting portion of the current collimator. The auxiliary electrode 319 has a toroidal shape and is located at least partially over the anode (has a non-zero footprint when projected onto the anode). The footprint projected onto the anode is shown as d5. In some embodiments, its footprint projected onto the anode is at least about 40% of total anode area, e.g., between about 40 and 80% of the total anode area. In some embodiments, the footprint of the current restricting portion of the ionic current collimator onto the anode is very similar to the footprint of the auxiliary anode, e.g., at least about 40% of total anode area, e.g., between about 40 and 80%.

Figure 3B:
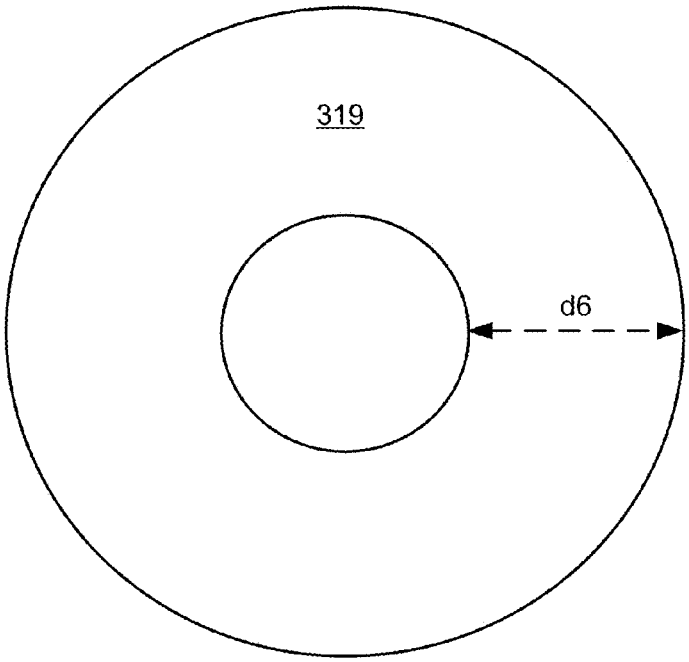
FIG. 3B is a schematic top view of an auxiliary electrode in accordance with an embodiment presented herein.

Further, in some embodiments the auxiliary electrode has a large surface area. When the surface area is large, the auxiliary electrode can accept a very high current (as often needed to compensate for the terminal effect caused by highly resistive seed layers), without building undesirably high current densities. In some embodiments, the surface area of the auxiliary electrode is at least about 600 $cm^2$, such as between about 900 $cm^2$ and 1200 $cm^2$. FIG. 3B illustrates a top view of the toroidal auxiliary electrode 319. In some embodiments, the electrode has a radial thickness d6 (difference between outer and inner radius) that is at least 60 mm, such as between about 60 mm and 150 mm.

Figure 4:
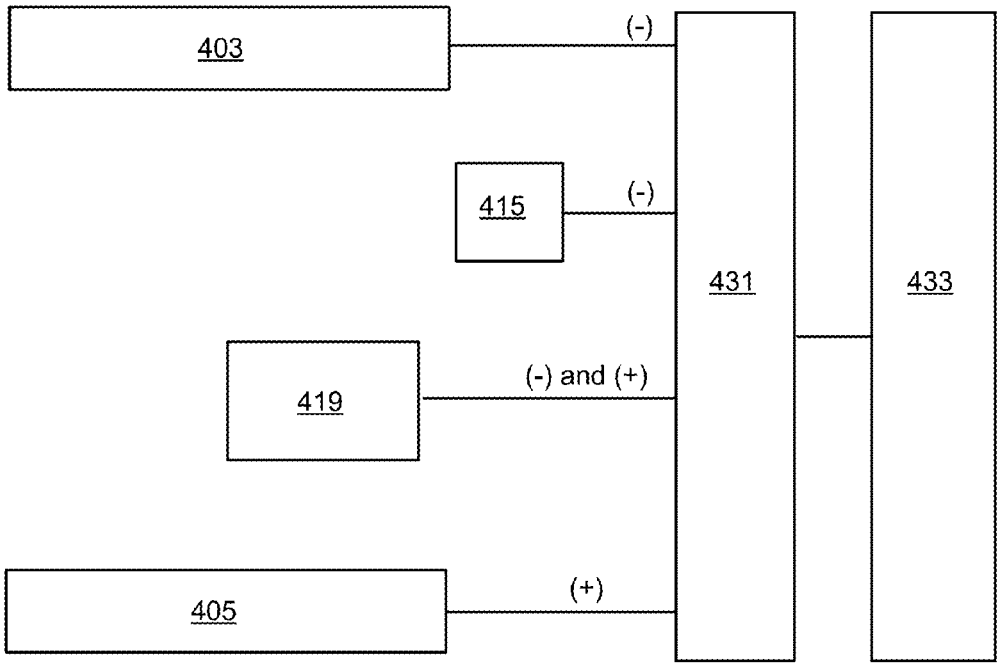
FIG. 4 is a schematic diagram illustrating electrical connectivity between the controller, power supply, and components of the plating cell in accordance with an embodiment provided herein.

FIG. 4 is a schematic illustration of electrical connectivity between the elements of the electroplating apparatus in accordance with one embodiment. The wafer substrate 403, the anode 405, the secondary thief cathode 415 and the auxiliary electrode 419 are connected to one or more power supplies 431 (shown as one block), which are configured to bias the substrate 403 negatively during electroplating, while concurrently biasing the anode 405 positively relative to the substrate, and while biasing the thief cathode 415 negatively at least during a portion of electroplating of one substrate, and while biasing the auxiliary electrode both negatively and positively during the course of electroplating of one substrate. Typically, the auxiliary electrode is negatively biased in the beginning of electroplating, and is positively biased later in the plating process. In some embodiments, the one or more power supplies 431 are also configured to bias the main anode cathodically, when the auxiliary electrode is biased anodically.

In certain embodiments, one or more power supplies are provided for providing power to the wafer substrate, the auxiliary electrode, and the secondary cathode. In some cases, a separate power supply is provided for each of the auxiliary electrode, the secondary cathode and the work piece; this allows flexible and independent control over delivery of power to each cathode. Alternatively, one power supply with multiple independently controllable electrical outlets can be used to provide different levels of current to the wafer, to the auxiliary electrode, and to the secondary cathode. In the embodiment depicted in FIG. 4, the anode is positively biased with respect to the wafer, the auxiliary electrode, and the secondary cathode, and is sometimes grounded.

In some embodiments the power supply 413 is a multi-channel power supply. One channel of the power supply 431 negatively biases the wafer 403 with respect to the anode; another channel of the power supply negatively biases the secondary cathode 415 with respect to the anode; and another channel of the power supply 431 negatively biases the auxiliary electrode in the beginning of plating with respect to the anode. The power supply 431 can be connected to a controller 433, which allows for independent control of current and potential provided to the wafer, the secondary cathode and auxiliary electrode of the electroplating apparatus. Power supply 431 causes an electrical current to flow from anode 405 to wafer 403, plating metal onto the wafer. The channel connected to secondary cathode 415 of power supply 431 causes the electrical current to flow from anode 405 to the secondary cathode 415, thereby partially or substantially diverting current that flows from anode 405 to wafer 403. Depending on the relative potential applied on the auxiliary electrode 419, auxiliary electrode 419 may either pull current from anode 405, or provide current to wafer 403. The electrical circuit described above may also include one or several diodes (not shown) that will prevent reversal of the current flow, when such reversal is not desired.

With separate power supplies or power supply channels for the auxiliary electrode, the secondary cathode, and the wafer, the current applied to each of the electrodes may be dynamically controlled. As the wafer is electroplated with metal, the sheet resistance decreases and the current distribution non-uniformity may be reduced, making the secondary cathode unnecessary after a certain thickness of metal is achieved. The current supplied to the secondary cathode and the auxiliary electrode may be dynamically controlled to account for a reduction of the wafer's sheet resistance and for the associated more uniform current distribution that normally results without the activation of the auxiliary electrode. In some embodiments, no current is supplied to the secondary cathode after the sheet resistance of the wafer drops to a defined level such as about 1 ohm per square and less. In some embodiments, the current that is supplied to the auxiliary electrode (in cathode mode) changes polarity after the sheet resistance of the wafer drops to a defined level such as about 7.5 ohm per square or lower, after which point the auxiliary cathode becomes an anode and starts to supply current to wafer 403. In other words, in one process sequence, in the very beginning of plating, both the secondary cathode (thief) and the auxiliary electrode (in cathode mode) are powered, and typically each receives more current than the wafer. Next, after a certain amount of plating, the polarity of the auxiliary electrode is switched from negative to positive, and then, after a further amount of plating, power to the thief is turned off, while the wafer is negatively biased all throughout the process receiving constant or changing current.

A controller 433 is electrically connected with the one or more power supplies 431 and is configured to control the electrical parameters applied to the apparatus components. For example the controller can control one or more of power, current and voltage applied to the components of the apparatus, and is capable of dynamically changing these parameters during the course of electroplating. In some embodiments, the controller includes program instructions, or logic for performing the methods provided herein.

Figure 5A:
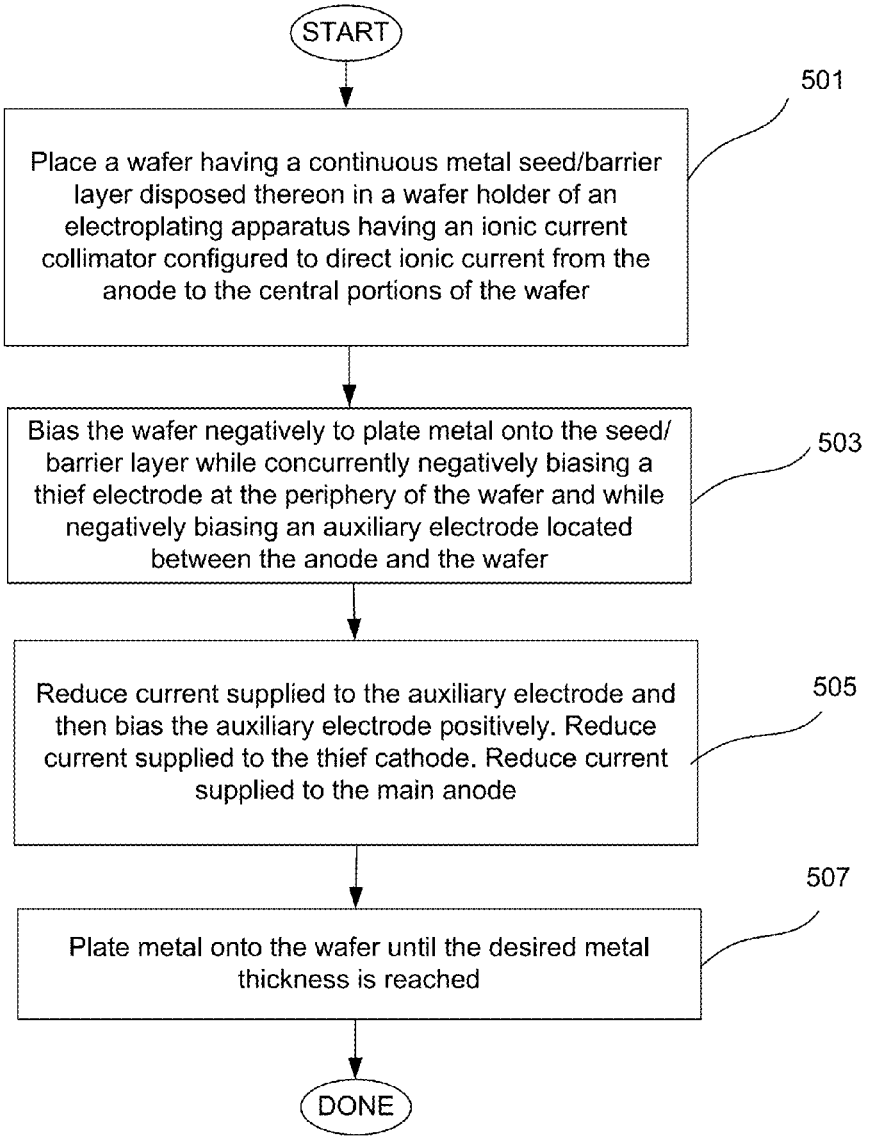
FIG. 5A is a process flow diagram for an electroplating method in accordance with an embodiment provided herein.

An electroplating method, in accordance with one embodiment, is illustrated by the process diagram shown in FIG. 5A. The process starts in 501 by placing a wafer having a continuous seed or barrier-seed layer in a wafer holder of an electroplating apparatus having an ionic current collimator configured to direct ionic current from the anode to the central portions of the wafer. Next, in 503, the wafer (in contact with electrolyte) is biased negatively to plate metal on the seed or barrier-seed layer, while concurrently a thief cathode located at the periphery of the wafer is negatively biased to divert ionic current from the near-edge region of the wafer. Concurrently, an auxiliary electrode located between the anode and the wafer is negatively biased. Next, in 505, the current supplied to the auxiliary electrode is reduced, and next, the auxiliary electrode is biased positively. Further, the current supplied to the thief cathode is reduced to a small amount, or the power to the thief cathode is turned off. Further, the current supplied to the main anode is reduced during the course of plating or even reversed to cathodic current, in some embodiments. The metal is plated in 507 until a desired thickness is reached.

In some embodiments the cathodic current provided to the auxiliary electrode in the beginning of electroplating is at least 200% of the current provided to the wafer substrate, such as at least 400% of the current provided to the wafer substrate. In some embodiments, this current is rapidly reduced, e.g., in the first 5 seconds of electroplating time, and is then switched to anodic current, which may be increased during the course of electroplating. In some embodiments, the current is decreased following an exponential function. In other embodiments, the current is decreased following a polynomial function. The time of the switch to the anodic mode can be determined, by calculating the projected sheet resistance of the wafer based on a number of input parameters (e.g., type of metal plated, size of wafer, and plating speed). Alternatively the projected sheet resistance may be calculated by measuring the number of coulombs that pass through the system, and knowing the type of metal being plated, and the size of the wafer. The switch time may occur after a certain projected sheet resistance has been reached. For example, for a deposition of a known metal on a wafer of a known size, it can be calculated at what time the sheet resistance decreases below a predetermined number. Therefore, the auxiliary electrode can be switched to an anode mode when the sheet resistance drops below a predetermined number (e.g., below 7.5 ohm/sq.)

Figure 5B:
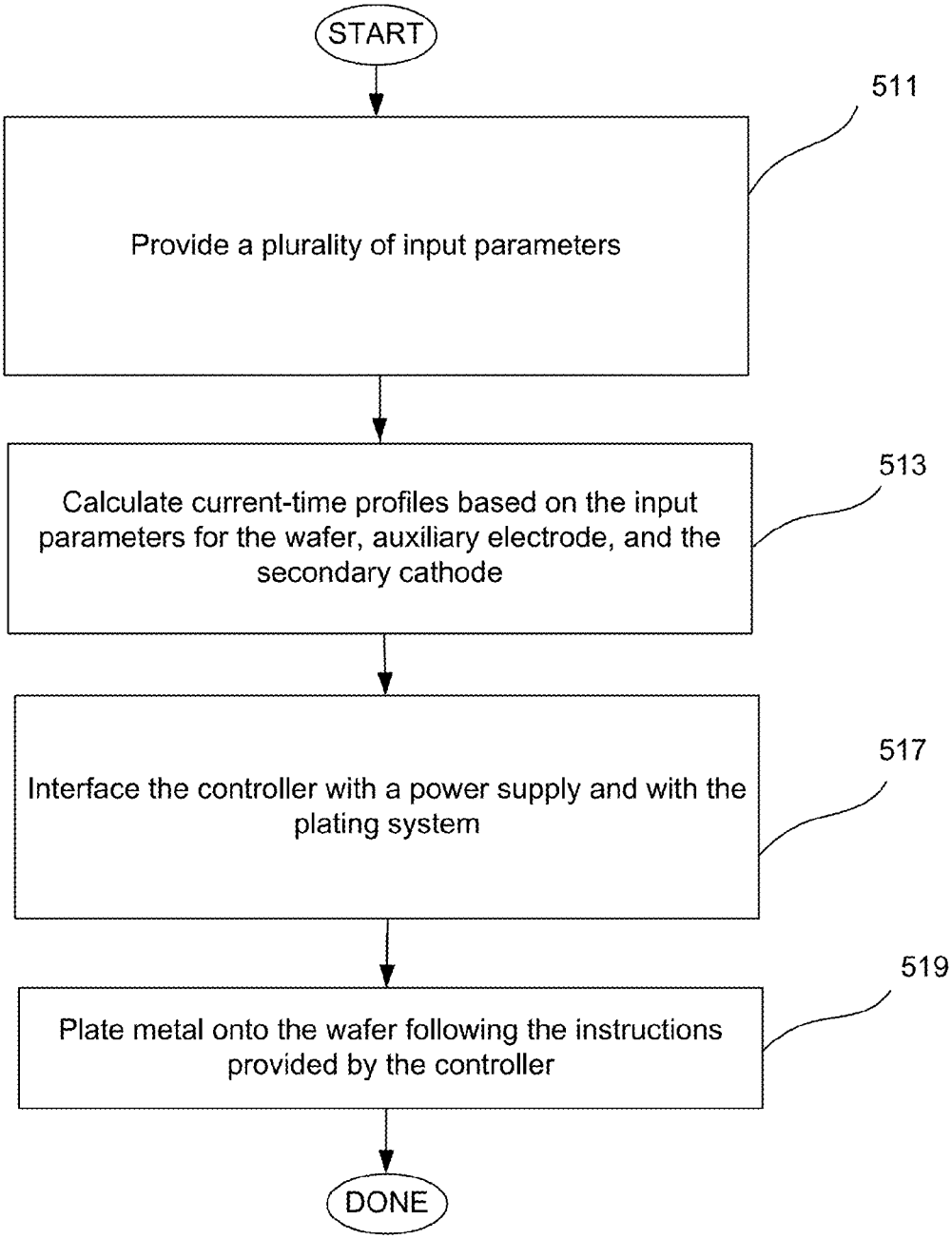
FIG. 5B is an example of an algorithm for determining and using controller instructions in accordance with an embodiment provided herein.

FIG. 5B illustrates an exemplary algorithm for configuring a system controller to perform the methods provided herein. In operation 511*a* plurality of input parameters are provided. These input parameters may include the size of the wafer, the type of metal, and the plating speed. Next, in 513, current-time profiles for one or more of the wafer, the secondary thief cathode, and the auxiliary electrode are calculated based on the input parameters. In 517, the controller having these current-time instructions is interfaced with the one or more power supplies and with the components of the electroplating system. Next, in 519, the metal is plated following the instructions provided by the system controller.

Controller 433 in conjunction with power supplies 431 allows for independent control of current and potential provided to the wafer, the auxiliary cathode, and the second auxiliary cathode of the electroplating apparatus, as well as control over other plating components. Thus, controller 433 is capable of controlling power supplies 431 to generate the current profiles described above. The controller, however, generally is not capable of independently determining if one of the conditions described above (e.g., sheet resistance reaching a level of 1 ohm per square or lower) has been met, though an estimate of the sheet resistance can be made based on a known total cumulative amount of charge passed to the wafer at any given time. Thus, the controller may be used in conjunction with sensors that may determine whether a condition has been met. Alternatively, the controller may be programmed with a separate current versus time profile for each of the wafer, auxiliary electrode, and the secondary cathode. The controller may also measure the charge (coulombs=integral of amperage*time) supplied to the wafer, auxiliary electrode, and secondary cathode, and base the current-time profile on these data.

Controller 433 may be configured to control electrical power delivered to the auxiliary electrode in a manner that produces a more uniform current distribution from the anode after electroplating a defined amount of metal onto the substrate or after electroplating for a defined period of time. Controller 433 may also be configured to control electrical power delivered to a secondary cathode adapted for diverting a portion of ionic current from an edge region of the substrate. Furthermore, controller 433 may be configured to ramp down electrical power delivered to the auxiliary electrode 419 and the secondary cathode 415, each at different rates, as metal is deposited on the substrate. Additionally, controller 433 may be configured to supply anodic current after supplying cathodic current to the auxiliary electrode after the sheet resistance of the substrate surface reaches a first threshold level, and to supply no current or substantially no current to the secondary cathode after the sheet resistance of the substrate surface reaches a second threshold level.

Controller 433 may be further designed or configured to control the position of the wafer relative to the anode position, the rotation of the wafer in the wafer holder, etc. In the case where the auxiliary electrode and/or the collimator is movable, controller 433 can also control the movement parameters of the collimator and/or of the auxiliary cathode, such as the speed of movement and timing of starting and stopping the movement. The positions of the collimator and of the auxiliary cathode may be controlled based on a number of factors including, but not limited to, the sheet resistance of the substrate surface, time (i.e. how long the electrodeposition process has been going), and the amount of metal deposited onto the substrate surface. These factors allow for dynamic control of the collimator position, resulting in more uniform deposition across the wafer. For example, the controller may be configured and may comprise program instructions to initiate movement of one or both of the collimator and of the auxiliary electrode after a threshold sheet resistance is reached, or after a predetermined amount of time, or after a predetermined amount of plating has occurred.

Figure 6A:
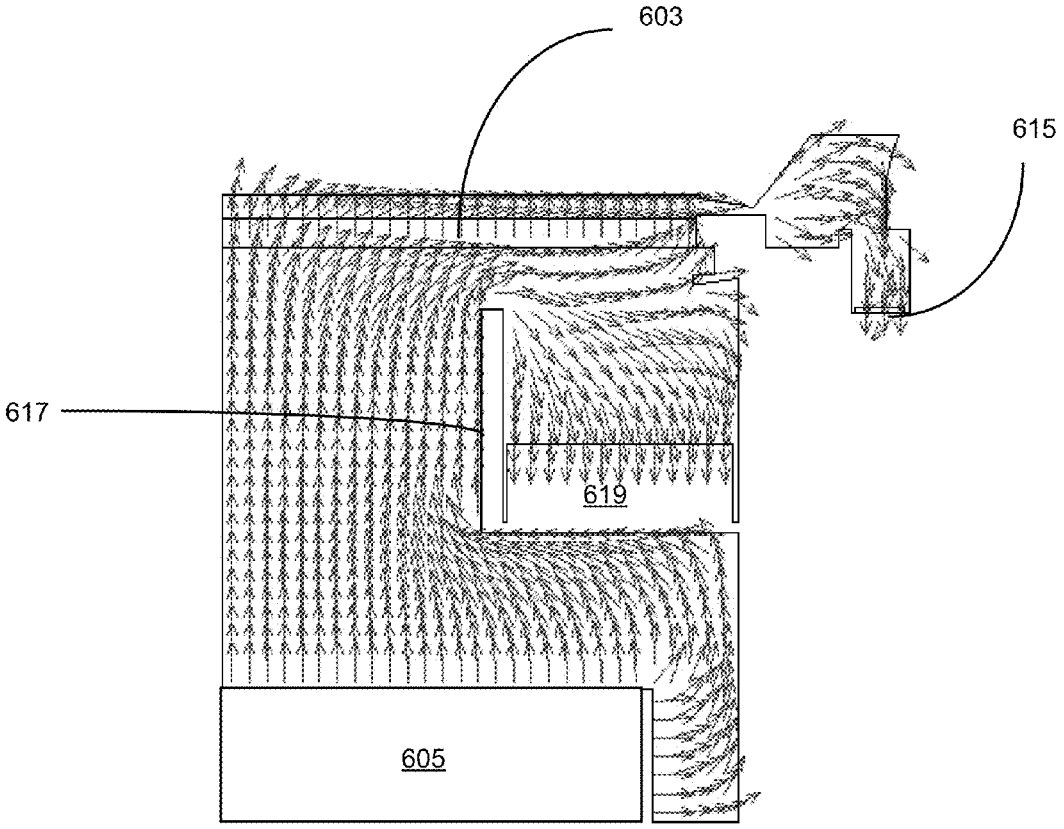
FIG. 6A shows a computational modeling result illustrating ionic current distribution in the electroplating apparatus during the first stage of plating, in accordance with an embodiment provided herein.

FIG. 6A illustrates results of computational modeling illustrating ionic current distribution in the beginning of electroplating, when the auxiliary electrode serves as an auxiliary cathode. In the illustrated system, the ionic current is directed from the main anode 605 (at a ground potential) to the central opening of the ionic current collimator 617, from where it proceeds to the central portions of the wafer 603 (negatively biased), and is partially diverted towards the negatively biased auxiliary electrode 619. The excess of ionic current reaching the edges of the wafer 603 is diverted to a negatively biased thief cathode 615 which resides in a chamber around the periphery of the wafer and is connected to the main plating bath via a narrow channel.

Figure 6B:
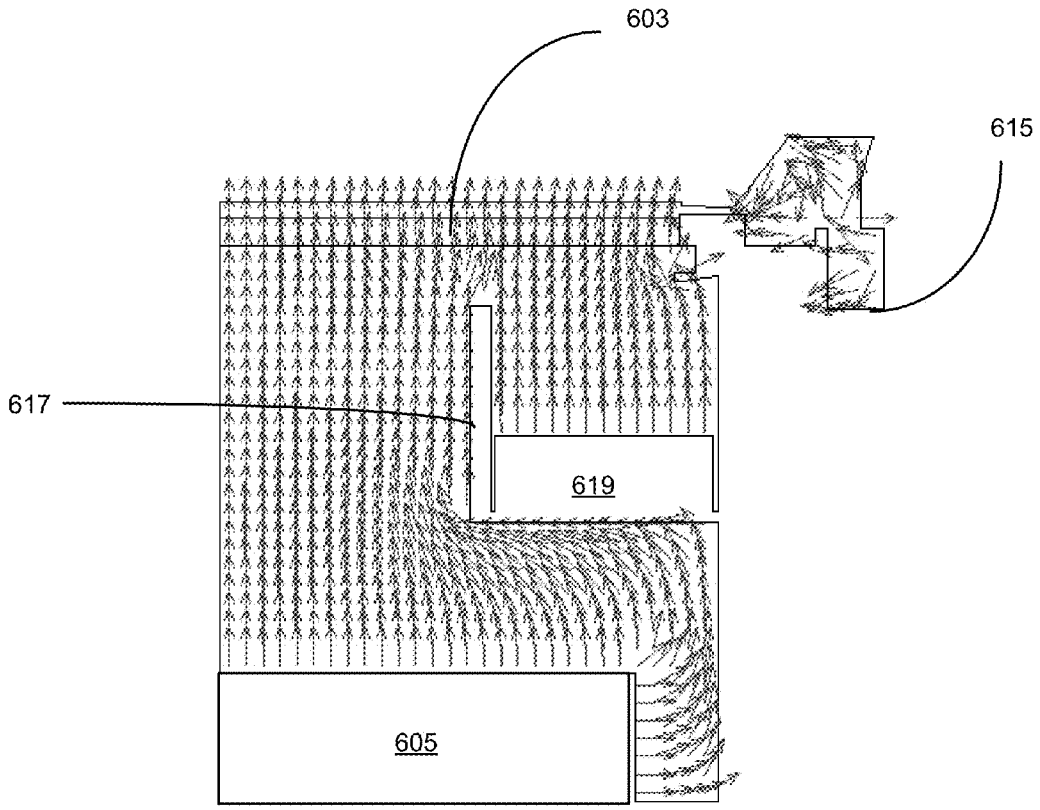
FIG. 6B shows a computational modeling result illustrating ionic current distribution in the electroplating apparatus during the second stage of plating, in accordance with one embodiment provided herein.

FIG. 6B illustrates results of computational modeling illustrating ionic current distribution at a later stage in electroplating. In this case power to the secondary thief cathode 615 is turned off, and the auxiliary electrode 619 is positively biased and serves as an anode. The main anode 605 remains at a ground potential. It can be seen that the ionic current is now supplied both by the anode 605 and by the auxiliary electrode 619, where the ionic current from 619 is directed primarily to non-central regions of the wafer substrate 603. Thus, in a first stage of electroplating the system contains one anode, and three cathodes, while in the later stage of electroplating the system contains two anodes and one cathode (wafer).

Figure 7:
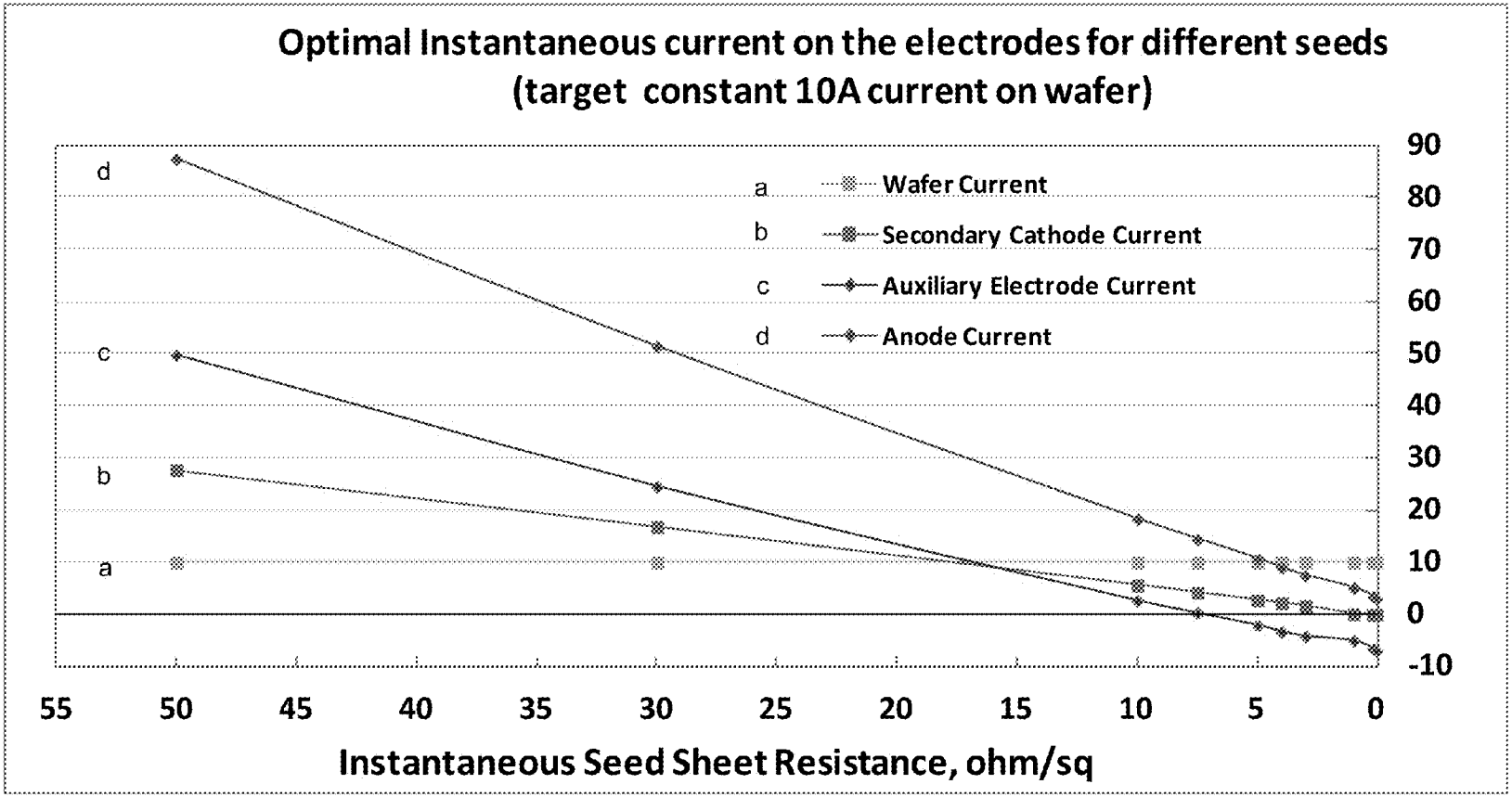
FIG. 7 is a plot illustrating preferred current levels for different components of the electroplating cell, as a function of seed layer sheet resistance, in accordance with one example presented herein.

FIG. 7 illustrates a plot of optimal instantaneous currents on the components of the plating cell for seed layers having different sheet resistances, in accordance with one implementation. The range of sheet resistances is from about 0.05 ohm/sq (corresponding to about 4000 Å copper layer) to about 50 ohm/sq. The curve (a) shows that the cathodic current provided to the wafer substrate is constant at 10 A. Curve (b) illustrates the cathodic current provided to the secondary cathode during plating. As the sheet resistances decrease, the amount of cathodic current supplied to the secondary cathode also decreases. Curve (c) illustrates the current supplied to the auxiliary electrode. For highly resistive seed layers (7.5-50 Ohm/sq) a cathodic current is supplied to this electrode. The cathodic current decreases as the sheet resistance decreases from 50 Ohm/sq. to 7.5 Ohm/sq. At 7.5 Ohm/square no current is supplied to this electrode, and at lower sheet resistances, the polarity of the electrode is switched, and it starts accepting positive current and starts serving as an auxiliary anode. The anodic current is increased, as the sheet resistance is further decreased. Curve (d) shows the current at the main anode. The current at the anode decreases as the sheet resistances decrease (anodic current for the main anode is defined as positive in this plot).

Figure 8:
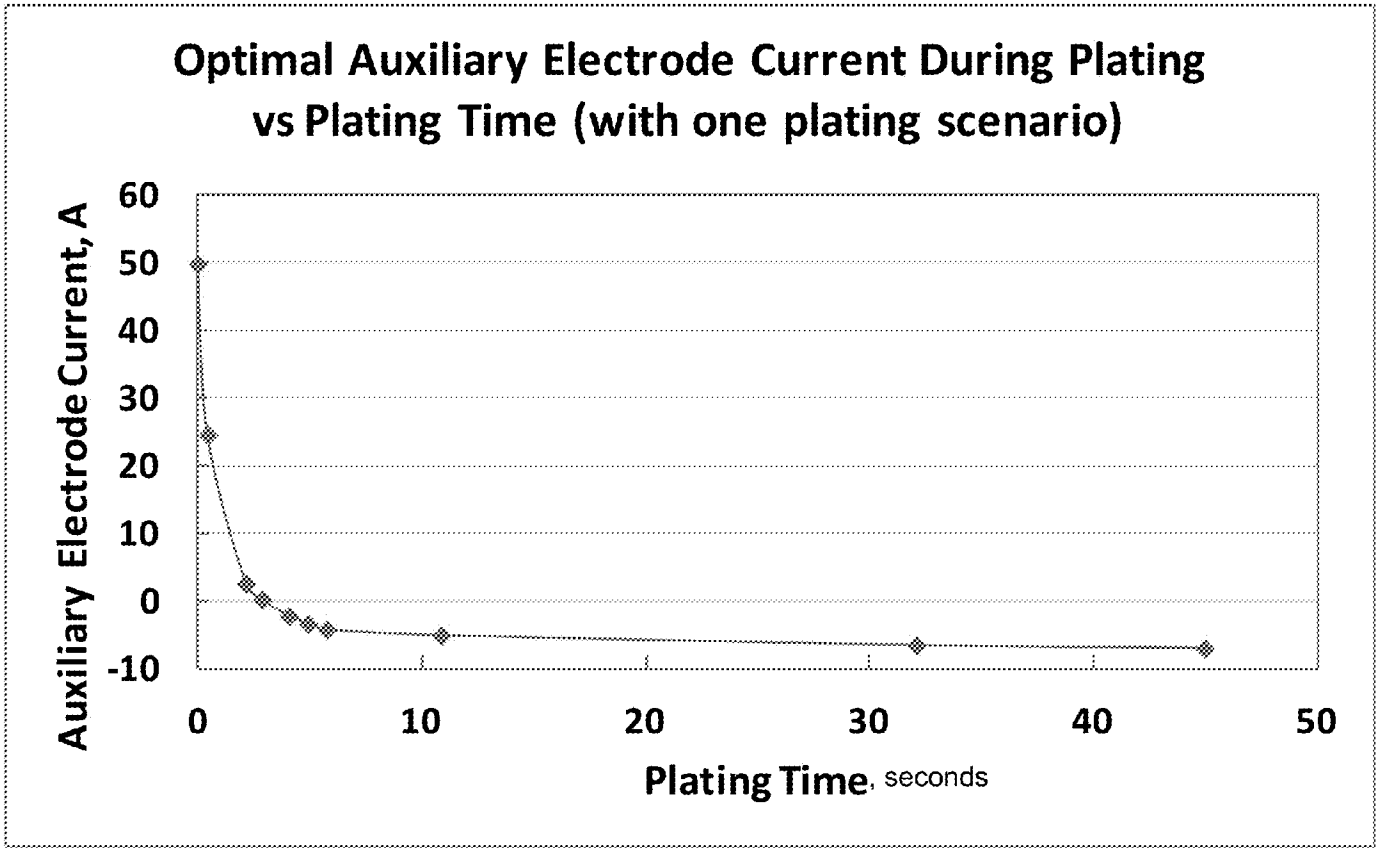
FIG. 8 is a plot illustrating preferred current levels for an auxiliary electrode as a function of electroplating time.

FIG. 8 illustrates one exemplary scenario of current vs. time profile that may be employed for the auxiliary electrode when plating on resistive seeds. The process starts by applying a cathodic current of about 50 A to the auxiliary cathode, rapidly decreasing the cathodic current over less than 5 seconds, then transitioning to anodic current, then increasing the anodic current, and then plating at a relatively constant anodic current at the auxiliary electrode for at least 30 seconds. The current to the wafer follows the following waveform: 10 A for the first 5 seconds, followed by 15 A for the next 30 seconds, followed by 90 A for the remainder of the plating time. For the purposes of this calculation the current is normalized to a constant wafer current of 10 A. The current to the main anode decreased over time, such that after about 30 seconds of plating, the anodic current of the auxiliary electrode was higher than at the "main" anode. Therefore, the anodes switched roles in this scenario, with the auxiliary anode serving as the "main" anode during the later portion of plating.

Figure 9:
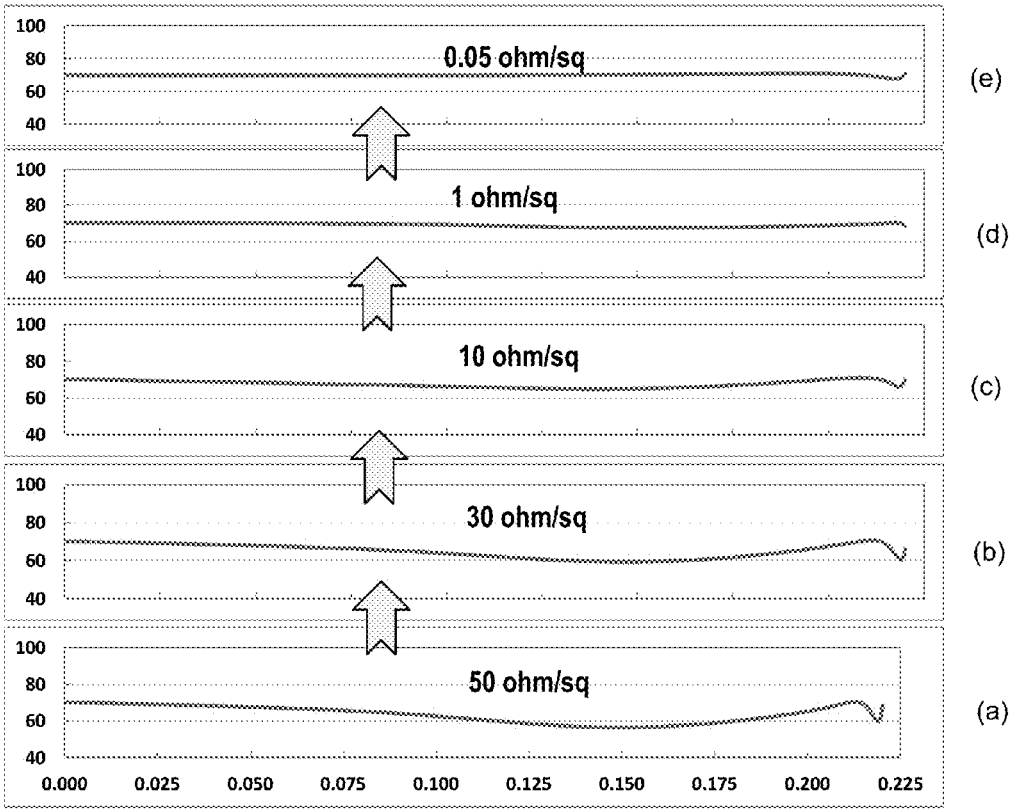
FIG. 9 is an illustration of instantaneous current distribution on the wafer substrate at various stages of the plating.

FIG. 9 illustrates computational modeling results showing distribution of current at the surface of the wafer during one exemplary electroplating sequence. The X-axis refers to a radial position on the wafer, starting at a center (0 m) and extending to the edge (0.225 m). The Y-axis shows the level of current in Amp/m$^2$. The electroplating process begins in (a), where the sheet resistance of the seed layer is 50 ohm·sq., the wafer receives a cathodic current of 10 A, the secondary thief cathode receives a cathodic current of 27.7 A, and the auxiliary electrode receives a cathodic current of 49.7 A. Next, after 0.45 seconds in (b) the sheet resistance drops to 30 Ohm/sq., the wafer receives a cathodic current of 10 A, the secondary thief cathode receives a smaller cathodic current of 16.8 A, and the auxiliary electrode receives a smaller cathodic current of 24.6 A. Next, after 2.1 seconds after beginning of plating, in (c) the sheet resistance drops further to 10 Ohm/sq., the wafer receives a cathodic current of 10 A, the secondary thief cathode receives a smaller cathodic current of 5.6 A, and the auxiliary electrode receives a smaller cathodic current of 2.7 A. Next, after 11 seconds after beginning of plating, in (d) the sheet resistance drops further to 1 Ohm/sq., the wafer receives a cathodic current of 10 A, the secondary thief cathode receives a smaller cathodic current of 0.1 A, and the auxiliary electrode receives switches polarity and receives an anodic current of −5 A. Finally, after 45 seconds after beginning of plating, in (e) the sheet resistance drops further to 0.05 Ohm/sq., the wafer receives a cathodic current of 10 A, the secondary thief cathode is turned off and receives zero current, and the auxiliary electrode receives a higher anodic current of −6.9 A. It can be seen that a highly uniform distribution of current across the wafer surface, and, consequently, uniform plating can be achieved using provided electroplating sequences.

The programming of the apparatus controller with a desired current-time characteristic can be performed, in some embodiments, following the exemplary guidelines presented below.

As shown in FIG. 7, the optimal current on the auxiliary electrode and on the secondary cathode is linearly correlated with the instantaneous sheet resistance of the seed wafer substrate. Thus in a plating process, due to constant plating occurring on the wafer substrate, the preferred process involves dynamic changing and smart control of current on the auxiliary electrode and on the secondary cathode.

Control of the current level on the auxiliary electrode (as well as on the secondary cathode) is designed in some embodiments based on the linear correlation between the optimal current level and the instantaneous substrate sheet resistance. The following three aspects can be merged into a single mathematical model which can be implemented through waveform control (current—time function for each of the components of the apparatus). This function can be included in the controller in the form of program instructions, e.g., via inclusion into the power supply firmware control unit. According to a first aspect, there is a linear correlation between the sheet resistance of the wafer substrate and the optimal current on the auxiliary cathode. According to a second aspect, in a plating process, the metal growth rate (thus the "seed" thickness increase rate) follows a step function. Thus, over a certain time period the growth rate is constant. Therefore, the thickness of the metal on the wafer substrate is linearly correlated with the time over each time period. According to a third aspect, the correlation between the sheet resistance of the wafer substrate and the thickness of the "seed" layer is not linear. Instead it could be mathematically illustrated as a polynominal function or an exponential function. The presented three correlations, when merged together, lead to a polynominal and/or exponential correlation between the optimal auxiliary electrode current and plating time, as illustrated in FIG. 8. Accordingly, in some embodiments, an instantaneous measurement of the substrate sheet resistance is not necessary.

In some embodiments, the control of the system is implemented using the following steps without using the sensors. In a first step, computational modeling is performed to determine the optimal current on the auxiliary electrode versus wafer sheet resistance for a given hardware design, as illustrated in FIG. 7. Next, confirming experiments are performed to finalize the determination of correlation between auxiliary electrode current and time for different metal layer growth rates. The obtained correlation will be suitable for providing control for a selected hardware design with certain hardware dimensions and arrangement. The obtained correlation can then be used to configure power supply firmware and software and to pre-define the constants of a polynominal function and/or an exponential function used by the controller, and thus define the current-time function. Input parameters provided by the apparatus user to configure the controller may include: initial seed layer thickness on the substrate, initial current on the auxiliary electrode, information that defines starting point of polynominal and/or exponential function, and initial plating current on the wafer substrate, which is determined by factors other than the auxiliary electrode parameters. Factors that determine the plating current on the wafer substrate include but are not limited to: types of structures on the wafer substrate, plating bath chemistry used for plating on the wafer substrate, integration requirements, etc.

CONCLUSION

It is understood that the examples and embodiments described herein are for illustrative purposes only and that various modifications or changes in light thereof will be suggested to persons skilled in the art. Although various details have been omitted for clarity's sake, various design alternatives may be implemented. Therefore, the present examples are to be considered as illustrative and not restrictive, and the invention is not to be limited to the details given herein, but may be modified within the scope of the appended claims. Further it is understood that many features presented in this application can be practiced separately as well as in any suitable combination with each other, as will be understood by one of skill in the art.

The invention claimed is:

1. An electroplating apparatus for depositing metal on a wafer substrate, the apparatus comprising:

(a) a plating vessel configured for holding an electroplating solution therein;

(b) a wafer substrate holder configured for holding the wafer substrate in position during electroplating, the wafer substrate holder having one or more electrical power contacts arranged to contact an edge of the substrate and to provide electrical current to the wafer substrate during electroplating, wherein the apparatus is configured for cathodically biasing the wafer substrate during electroplating;

(c) an anode residing in the plating vessel, wherein the anode is configured to be anodically biased at least during a portion of electroplating;

(d) an ionic current collimator proximate the anode, wherein the ionic current collimator is a non-conductive member configured to direct an ionic current from the anode generally in a direction from a periphery to a center of the plating vessel; and (e) an auxiliary electrode configured to be both cathodically and anodically biased during electroplating, wherein a footprint of the auxiliary electrode onto the anode is at least about 40% of an anode area, and wherein the auxiliary electrode resides between the ionic current collimator and the wafer substrate holder.

2. The apparatus of claim 1, wherein the ionic current collimator comprises:

(i) a central portion in the form of an open cylinder extending in a direction that is perpendicular to a plating surface of the wafer substrate, wherein the openings of the cylinder provide a route for the ionic current; and (ii) a current restricting portion connected to the central portion, the current restricting portion extending in a direction that is parallel to the plating surface of the wafer substrate.

3. The apparatus of claim 2, wherein the current restricting portion of the ionic current collimator extends to sidewalls of the plating vessel, and is configured to block ionic current at the periphery of the plating vessel.

4. The apparatus of claim 3, wherein the current restricting portion of the ionic current collimator is attached to the sidewalls of the plating vessel.

5. The apparatus of claim 1, wherein the ionic current collimator is made of a dielectric material that is not permeable to electrolyte and is selected from the group consisting of polycarbonate, polyethylene, polypropylene, polyvinylidene difluoride (PVDF), polytetrafluoroethylene, and polysulphone.

6. The apparatus of claim 1, wherein the ionic current collimator does not contact the anode and is spaced from the anode by a distance of at least about 15% of the wafer substrate radius.

7. The apparatus of claim 1, wherein the ionic current collimator is configured to be moveable in a direction that is perpendicular to a plating surface of the wafer substrate during electroplating.

8. The apparatus of claim 1, wherein the ionic current collimator is configured to be stationary during electroplating.

9. The apparatus of claim 1, wherein the ionic current collimator serves as a platform supporting the auxiliary electrode.

10. The apparatus of claim 1, further comprising one or more power supplies configured to bias the auxiliary electrode both negatively and positively during the course of electroplating.

11. The apparatus of claim 1, wherein the auxiliary electrode comprises copper at least on the surface of the auxiliary electrode.

12. The apparatus of claim 1, wherein the apparatus is configured to bias the auxiliary electrode negatively in the beginning of electroplating to divert ionic current, and then positively to donate ionic current.

13. The apparatus of claim 1, wherein the auxiliary electrode has a generally toroidal shape and a thickness of at least about 20 mm.

14. The apparatus of claim 1, wherein the auxiliary electrode has a working surface of at least about 600 $cm^2$.

15. The apparatus of claim 1, further comprising a controller comprising program instructions and/or built in logic for:

(i) in a first electroplating stage, electroplating metal onto the wafer substrate while cathodically biasing the auxiliary electrode; and (ii) in a second electroplating stage, electroplating metal onto the wafer substrate while anodically biasing the auxiliary electrode.

16. The apparatus of claim 1, included in a system, further comprising a stepper.

* * * * *